US005778854A

United States Patent [19]

Arai

[11] Patent Number: 5,778,854

[45] Date of Patent: Jul. 14, 1998

[54] CYLINDER-DISCRIMINATING DEVICE FOR INTERNAL COMBUSTION ENGINES

[75] Inventor: Hideaki Arai, Wako, Japan

[73] Assignee: Honda Giken Kogyo Kabushiki Kaisha, Tokyo, Japan

[21] Appl. No.: 831,601

[22] Filed: Apr. 10, 1997

[30] Foreign Application Priority Data

Apr. 12, 1996 [JP] Japan ..... 8-115444

[51] Int. Cl.[6] ..... F02P 5/00

[52] U.S. Cl. ..... 123/414

[58] Field of Search ..... 123/414, 630, 123/617, 643, 613, 476, 479; 364/431.04

[56] References Cited

U.S. PATENT DOCUMENTS

| | | | |
|---|---|---|---|
| 5,630,396 | 5/1997 | Fukui et al. | 123/414 |
| 5,632,246 | 5/1997 | Fukui et al. | 123/414 |
| 5,647,322 | 7/1997 | Fukui et al. | 123/414 |
| 5,671,145 | 9/1997 | Krebs et al. | 364/431.04 |
| 5,671,714 | 9/1997 | Fukui et al. | 123/414 |

FOREIGN PATENT DOCUMENTS

| | | | |
|---|---|---|---|
| 56-143358 | 11/1981 | Japan | 123/414 |
| 58-8267 | 1/1983 | Japan | 123/414 |
| 1-203656 | 8/1989 | Japan | 123/414 |
| 2-271055 | 11/1990 | Japan | 123/414 |
| 4-287841 | 10/1992 | Japan | 123/414 |
| 6-81705 | 3/1994 | Japan | 123/414 |

*Primary Examiner*—Raymond A. Nelli

*Attorney, Agent, or Firm*—Nikaido, Marmelstein, Murray & Oram LLP

[57] ABSTRACT

A cylinder-discriminating device for an internal combustion engine is provided. A reference timing signal is generated whenever the engine rotates through a predetermined rotational angle. A sparking voltage produced in a particular cylinder or a particular cylinder group in response to an ignition timing signal generated in synchronism with generation of the reference timing signal is detected. Cylinder discrimination is carried out to discriminate between cylinders or between cylinder groups, based on the sparking voltage detected. In another form, sparking voltages produced in respective cylinders or respective cylinder groups in response to an ignition timing signal generated in synchronism with generation of the reference timing signal are detected. Cylinder discrimination is carried out to discriminate between the cylinders or between the cylinder groups, based on the sparking voltages detected.

24 Claims, 22 Drawing Sheets

ECU
INPUT CIRCUIT
CPU
MEMORY DEVICE
OUTPUT CIRCUIT
15
15a
15b
15c
15d
θ igp1
θ igp2
θ igp3
θ igp4
6
1
7
7a
7b
8
8a
8b
9
9a
9b
10
10a
10b
11
12
13
14
20
2
3
4
5
#1
#2
#3
#4
TDC
CRK
TEMPERATURE SENSOR
θ TH
FUEL INJECTION VALVE
19
18
17
16
21
VB

*FIG.7A* TDC TIMING

*FIG.7B* CYLINDER #1

*FIG.7C* CYLINDER #2

*FIG.7D* CYLINDER #3

*FIG.7E* CYLINDER #4

CRK
TIMING

CYLINDER #1
INTAKE
COMPRESSION
EXPLOSION
EXHAUST
INTAKE
COMPRESSION

CYLINDER #2
COMPRESSION
EXPLOSION
EXHAUST
INTAKE
COMPRESSION
EXPLOSION

CYLINDER #3
EXHAUST
INTAKE
COMPRESSION
EXPLOSION
EXHAUST

CYLINDER #4
EXPLOSION
EXHAUST
INTAKE
COMPRESSION
EXPLOSION
EXHAUST

*FIG.14A* TDC TIMING

*FIG.14B* CYLINDER #1

*FIG.14C* CYLINDER #2

*FIG.14D* CYLINDER #3

*FIG.14E* CYLINDER #4

CYLINDER-DISCRIMINATING DEVICE FOR INTERNAL COMBUSTION ENGINES

BACKGROUND OF THE INVENTION

1. Field of the Invention

This invention relates to a cylinder-discriminating device for internal combustion engines having a plurality of cylinders, which includes an ignition device having ignition coils provided for respective ones of the cylinders or for respective cylinder groups.

2. Prior Art

In general, a four-cycle internal combustion engine, such as a gasoline engine for automotive vehicles, has a plurality of cylinders each driven in a cycle of four strokes, i.e. intake stroke, compression stroke, explosion stroke, and exhaust stroke. An air-fuel mixture is drawn into each cylinder of the engine, compressed therein, and ignited by a spark generated by a spark plug of the cylinder for combustion to produce torque. To make the most efficient use of pressure generated by combustion or explosion of the mixture in each cylinder as a force for pushing down a piston therein, it is important to cause the mixture to be ignited by a spark at the optimal crank angle position, and at the same time supply a sufficient amount of energy for ignition to the spark plug. To this end, ignition control is carried out while executing cylinder discrimination (i.e. determination of the stroke of each cylinder).

On the other hand, an ignition control system of electronically-controlled type generally employed for supplying ignition energy to the spark plug of each cylinder utilizes a pulse generated whenever the crankshaft of the engine rotates through a predetermined angle (e.g. 180 degrees) as a signal indicative of basic timing for determining ignition timing, and a pulse generated whenever the crankshaft rotates through a predetermined angle (e.g. 30 degrees) as a counting signal for control of advanced ignition timing with respect to the basic timing, whereby an ignition command signal is generated for igniting the mixture in each cylinder at advanced timing dependent on load on the engine. The ignition command signal controls the operation of a transistor connected to a primary side of each ignition coil, to thereby cause breakage of current flowing through the primary side of the ignition coil, whereby high-voltage current is generated, which is distributed by a distributor to the spark plug of each cylinder.

The cylinder discrimination is carried out to determine a crank angle position of each cylinder and a stroke thereof defined in relation to a stroke of a particular cylinder for reference. Four-cycle internal combustion engines complete the four-stroke cycle by two rotations of the crankshaft. This means that it requires the maximum two rotations of the crankshaft to detect the particular cylinder for reference on its particular stroke without fail. Therefore, if the cylinder discrimination is carried out by detecting a projection formed on a rotor rotating in unison with the crankshaft, detection of the projection only teaches that either a first cylinder (#1) or a fourth cylinder (#4) is on its particular stroke, but it is impossible to definitely discriminate which of them is on the particular stroke. To overcome this inconvenience, an alternative method to the above method of cylinder discrimination has been proposed by Japanese Laid-Open Patent Publication (Kokai) No. 1-203656, in which a driving shaft specially provided for the cylinder discrimination, which rotates in unison with the crankshaft, is coupled to the camshaft of the engine by gears or by Oldham's coupling, whereby the rotational angle of the driving shaft is detected for the purpose of discrimination between the cylinders.

However, the ignition/distribution method described above, which uses a distributor, is low in energy efficiency due to consumption of most of the ignition energy through discharge between electrodes of the distributor and resistance of high-voltage cables connecting the distributor with the ignition coils and the spark plugs.

To enhance the energy efficiency, there has been proposed an ignition control method of low-voltage current distribution type in which low voltage current is distributed to spark plugs without using any distributor. This ignition control method includes a cylinder-by-cylinder individual ignition system proposed e.g. by Japanese Laid-Open Patent Publication (Kokai) No. 58-008267, in which ignition coils are provided for respective cylinders, and a distributorless ignition system proposed e.g. by Japanese Laid-Open Patent Publication (Kokai) No. 56-143358, in which a plurality of (e.g. a pair of) spark plugs are connected to each ignition coil for simultaneous ignition of the plurality of (pair of) cylinders.

The cylinder-by-cylinder individual ignition system or the distributorless ignition system causes an ignition command signal controlled in ignition timing to be distributed via a cylinder-by-cylinder distribution circuit to each ignition coil, and the ignition command signal thus distributed turns on and off a transistor connected to the primary side of the ignition coil of each cylinder. Thus, ignition energy is sequentially supplied to the ignition coils of the cylinders.

For example, in the case of the distributorless ignition system of a four-cylinder internal combustion engine which performs simultaneous ignition at each pair of cylinders, two transistors connected in parallel with the primary sides of ignition coils are sequentially or alternately controlled by the ignition command signal from the cylinder-by-cylinder distribution circuit to produce high voltages on the secondary sides of the ignition coils sequentially or alternately, which are sequentially applied to respective corresponding pairs of spark plugs connected in series with the secondary sides of the ignition coils, whereby ignition is carried out at the first, third, fourth and second cylinders, in the mentioned order. In this distributorless ignition system, to prevent the sequence of ignitions for the cylinders from being brought out of order when the engine is started or in operation, a cylinder for which ignition should be first carried out in each ignition cycle is always set to an identical cylinder. To set the cylinder for the first ignition in each cycle to an identical cylinder at all times, it is required to generate a pulse signal whenever the crankshaft rotates through 720 degrees, and reset the cylinder-by-cylinder distribution circuit once per two rotations of the crankshaft.

The pulse signal generated for every 720 degrees cannot be obtained by a cylinder-discriminating sensor directly coupled to the crankshaft, so that a driving shaft specially used for the cylinder discrimination is coupled to the camshaft by gears or by Oldham's coupling for rotation at half the rotational speed of the crankshaft to thereby generate the pulse signal every 720 degrees of rotations.

However, this method requires providing the driving shaft specially for the cylinder discrimination, which increases the manufacturing cost.

One alternative to the method has been proposed by Japanese Laid-Open Patent Publication (Kokai) No. 02-271055 or Japanese Laid-Open Patent Publication (Kokai) No. 06-081705, in which the top dead center (TDC) position of a particular cylinder is determined based on pulses each generated by a cylinder-discriminating sensor arranged on the camshaft whenever the sensor detects one rotation of the camshaft. The cylinder-discriminating sensor used in this method includes a magnetic sensor, an optical sensor, a Hall sensor, an MRE sensor, etc.

On the other hand, there has been also proposed by Japanese Laid-Open Patent Publication (Kokai) No. 04-287841 a cylinder-discriminating method which employs a sensor arrangement which dispenses with the need of machining a camshaft for detection of rotation of the camshaft.

The former cylinder-discriminating methods (proposed by Japanese Laid-Open Patent Publications (Kokai) Nos. 02-271055 and 06-081705) incur increased manufacturing costs due to the use of an expensive sensor, such as a magnetic sensor, an optical sensor, a Hall sensor, and an MRE sensor.

Further, it is difficult for the latter method (proposed by Japanese Laid-Open Patent Publication No. 04-287841) to attain high accuracy of cylinder-discrimination due to limitations resulting from the sensor arrangement.

SUMMARY OF THE INVENTION

It is an object of the invention to provide a cylinder-discriminating device for an internal combustion engine, which is capable of discriminating between cylinders of the engine with high accuracy and at reduced costs.

To attain the above object, according to a first aspect of the invention, there is provided a cylinder-discriminating device for an internal combustion engine having a plurality of cylinders, and ignition means for effecting ignition at the plurality of cylinders, the ignition means having ignition coils provided, respectively, for the plurality of cylinders or for a plurality of cylinder groups of the plurality of cylinders.

The cylinder-discriminating device according to the first aspect of the invention is characterized by comprising:

- reference timing signal-generating means for generating a reference timing signal whenever the engine rotates through a predetermined rotational angle,
- ignition timing signal-generating means for generating an ignition timing signal for causing ignition at a particular cylinder of the plurality of cylinders or a particular cylinder group of the plurality of cylinder groups in synchronism with generation of the reference timing signal;
- voltage-detecting means for detecting a sparking voltage produced in the particular cylinder or the particular cylinder group when the ignition timing signal is generated; and
- cylinder-discriminating means for carrying out cylinder discrimination to discriminate between the plurality of cylinders or between the plurality of cylinder groups, based on the sparking voltage detected by the voltage-detecting means.

Preferably, the cylinder-discriminating means compares between a value of the sparking voltage detected by the voltage-detecting means and a predetermined voltage value, and carries out the cylinder discrimination, based on results of the comparison.

Preferably, the predetermined voltage value is set to a value close to a sparking voltage to be produced at a top dead center position of each of the plurality of cylinders at an end of a compression stroke thereof, the cylinder-discriminating means carrying out the cylinder discrimination by determining that the particular cylinder or the particular cylinder group was at the top dead center position at the end of the compression stroke when the ignition timing signal was generated, if the sparking voltage produced in the particular cylinder or the particular cylinder group, detected by the voltage-detecting means, is higher than the predetermined voltage value.

Alternatively, the cylinder-discriminating means compares between values of the sparking voltage produced in the particular cylinder or the particular cylinder group, detected by the voltage-detecting means over one cycle of operation of the engine, and carries out the cylinder discrimination, based on results of the comparison.

Preferably, the cylinder-discriminating means carries out the cylinder discrimination when the engine is in a particular operating condition.

More preferably, the particular operating condition of the engine includes at least a starting condition of the engine.

Further preferably, the particular operating condition of the engine includes at least a predetermined decelerating condition of the engine.

Preferably, the sparking voltage-detecting means detects, as the sparking voltage, a voltage on a primary side of one of the ignition coils which corresponds to the particular cylinder or the particular cylinder group.

Alternatively, the sparking voltage-detecting means detects, as the sparking voltage, a voltage on a secondary side of one of the ignition coils which corresponds to the particular cylinder or the particular cylinder group.

Preferably, the engine includes intake air amount control means for controlling an amount of intake air supplied to the engine, the cylinder-discriminating device including means for causing the intake air amount control means to control the amount of intake air in a manner such that the intake air is supplied to the engine in an amount suitable for the cylinder discrimination.

Preferably, the engine includes auxiliary air amount control means for controlling an amount of auxiliary air supplied to the engine, the cylinder-discriminating device including means for causing the auxiliary air amount control means to control the amount of auxiliary air in a manner such that the auxiliary air is supplied to the engine in an amount suitable for the cylinder discrimination.

For example, the engine includes a crankshaft, the predetermined rotational angle corresponding to a rotational angle of the crankshaft which is smaller than 90 degrees.

Alternatively, the predetermined rotational angle of the engine corresponds to an interval of generation of TDC signal pulses each generated when any of the plurality of cylinders is at a top dead center position.

To attain the above object, according to a second aspect of the invention, there is provided a cylinder-discriminating device for an internal combustion engine having a plurality of cylinders, and ignition means for effecting ignition at the plurality of cylinders, the ignition means having ignition coils provided, respectively, for the plurality of cylinders or for a plurality of cylinder groups of the plurality of cylinders.

The cylinder-discriminating device according to a second aspect of the invention is characterized by comprising:

- reference timing signal-generating means for generating a reference timing signal whenever the engine rotates through a predetermined rotational angle,
- ignition timing signal-generating means for generating ignition timing signals for causing ignition at respective ones of the plurality of cylinders or respective ones of the cylinder groups in synchronism with generation of the reference timing signal;

voltage-detecting means for detecting sparking voltages produced in the respective ones of the plurality of cylinders or the respective ones of the cylinder groups when the ignition timing signals are delivered; and cylinder-discriminating means for carrying out cylinder discrimination to discriminate between the plurality of cylinders or between the plurality of cylinder groups, based on the sparking voltages detected by the voltage-detecting means.

Preferably, the cylinder-discriminating means compares between values of the sparking voltages produced in the respective ones of the plurality of cylinders or the respective ones of the plurality of cylinder groups, detected by the voltage-detecting means, and carries out the cylinder discrimination, based on results of the comparison.

More preferably, the cylinder-discriminating means determines one of the values of the sparking voltages produced in the respective ones of the plurality of cylinders or the respective ones of the plurality of cylinder groups, detected by the voltage-detecting means, which has a largest absolute value, and determines that one of the plurality of cylinders or one of the cylinder groups corresponding to the one of the values of the sparking voltages which has the largest absolute value, was at a top dead center position of the one of the plurality of cylinders or the one of the cylinder groups at an end of a compression stroke thereof when a corresponding one of the ignition timing signals was generated.

Alternatively, the cylinder-discriminating means compares between values of the sparking voltage produced in the respective ones of the plurality of cylinders or the respective ones of the cylinder groups with a predetermined voltage value, and carries out the cylinder discrimination, based on results of the comparison.

The above and other objects, features and advantages of the invention will become more apparent from the following detailed description taken in conjunction with the accompanying drawings.

BRIEF DESCRIPTION OF THE DRAWINGS

FIGS. 3A to 3E show waveform diagrams showing characteristics of ignition waveforms of the engine appearing in FIG. 1, in which:

FIG. 3A shows an energization period over which an ignition coil is energized by an ignition command signal from the ECU;

FIG. 3B shows a primary current flowing through a primary coil of the ignition coil;

FIG. 3C shows a primary voltage produced on the primary coil;

FIG. 3D shows a secondary voltage produced on a secondary coil of the ignition coil; and FIG. 3E shows a secondary current flowing through the secondary coil;

FIGS. 5A and 5B collectively form a timing chart showing ignition timing of a particular cylinder (cylinder #1) synchronous with generation of each CRK signal pulse, in which:

FIG. 5A shows timing of generation of each CRK signal pulse; and

FIG. 5B shows cycles of strokes of the cylinder #1 together with ignition timing;

FIGS. 7A to 7E collectively form a timing chart showing ignition timing of a particular cylinder (cylinder #1) synchronous with generation of each TDC signal pulse, in which:

FIG. 7A shows timing of generation of each TDC signal pulse;

FIG. 7B shows cycles of strokes of the particular cylinder #1 together with ignition timing;

FIG. 7C shows cycles of strokes of a cylinder #2;

FIG. 7D shows cycles of strokes of a cylinder #3; and

FIG. 7E shows cycles of strokes of a cylinder #4;

FIGS. 12A to 12E collectively form a timing chart showing ignition timing of each cylinder synchronous with generation of a predetermined one of CRK signal pulses timed in a predetermined manner, in which:

FIG. 12A shows timing of generation of each CRK signal pulse;

FIG. 12B shows cycles of strokes of a cylinder #1 together with ignition timing;

FIG. 12C shows cycles of strokes of a cylinder #2 together with ignition timing;

FIG. 12D shows cycles of strokes of a cylinder #3 together with ignition timing; and FIG. 12E shows cycles of strokes of a cylinder #4 together with ignition timing;

FIGS. 14A to 14E collectively form a timing chart showing ignition timing of each cylinder in synchronism with generation of each TDC signal pulse, in which:

FIG. 14A shows timing of generation of each TDC signal pulse;

FIG. 14B shows cycles of strokes of a cylinder #1 together with ignition timing;

FIG. 14C shows cycles of strokes of a cylinder #2 together with ignition timing;

FIG. 14D shows cycles of strokes of a cylinder #3 together with ignition timing; and FIG. 14E shows cycles of strokes of a cylinder #4 together with ignition timing;

DETAILED DESCRIPTION

The invention will now be described in detail with reference to the drawings showing embodiments thereof.

Figure 1:
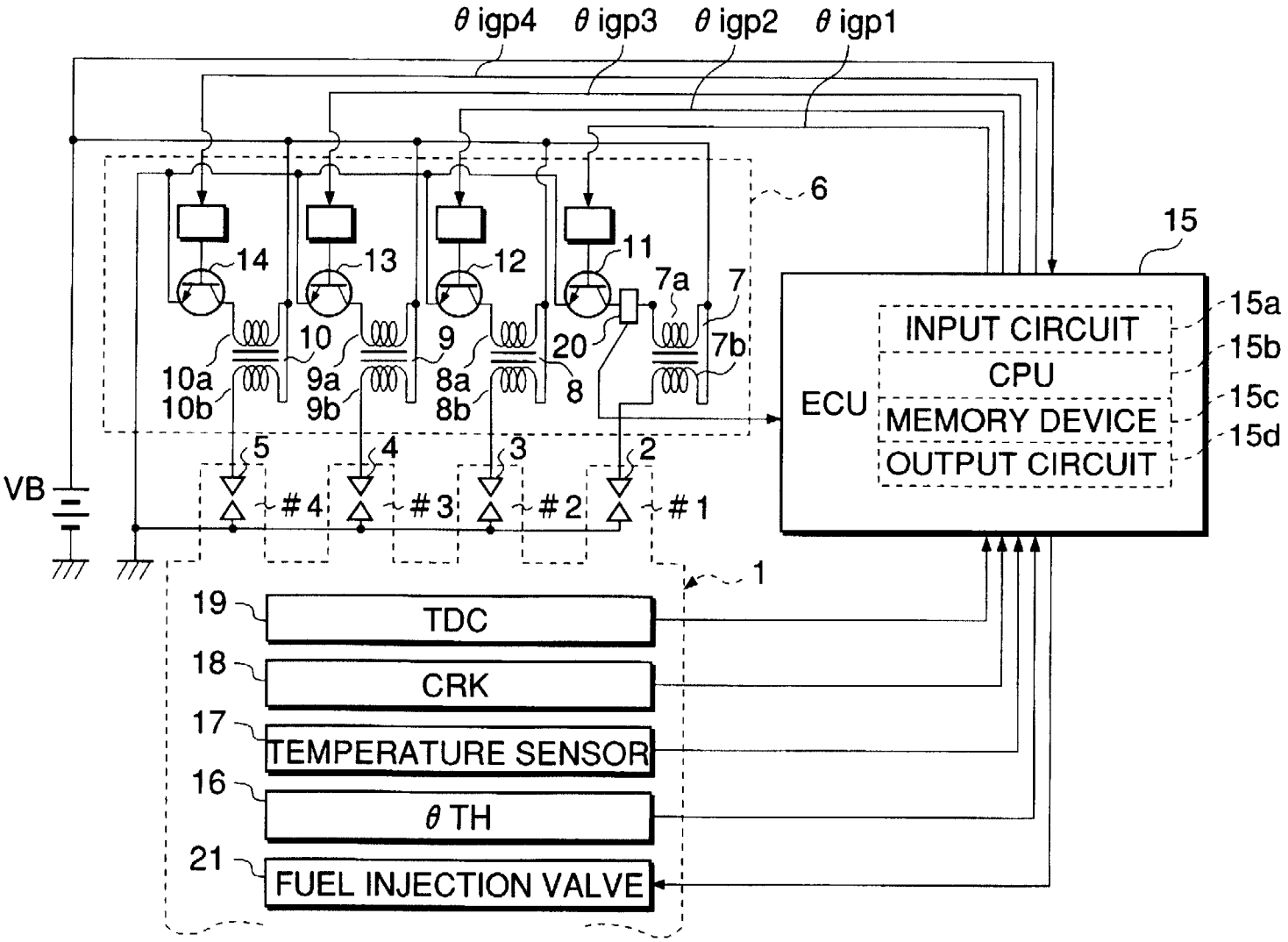
FIG. 1 is a block diagram schematically showing the whole arrangement of an internal combustion engine and a control system therefor incorporating a cylinder-discriminating device according to a first embodiment of the invention.
Figure 2:
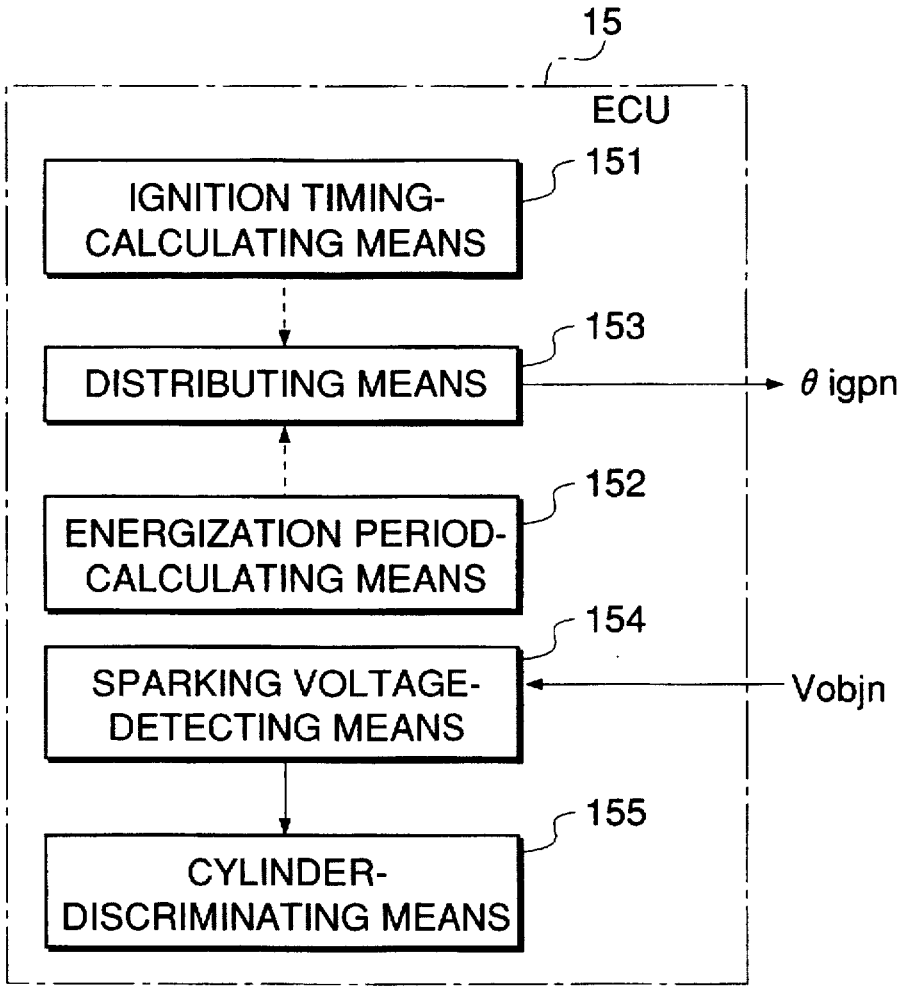
FIG. 2 is a block diagram schematically showing means involved in ignition timing control as part of an electronic control unit (ECU) 15 appearing in FIG. 1.

Referring first to FIG. 1, there is illustrated the whole arrangement of an internal combustion engine, and a control system therefor including a cylinder-discriminating device according to a first embodiment of the invention. FIG. 2 shows means involved in ignition timing control incorporated in an electronic control unit (ECU) 15 appearing in FIG. 1. In the present embodiment, the engine is assumed to be a four-cylinder type.

As shown in FIG. 1, the engine 1 includes four cylinders (#1, #2, #3, and #4), with spark plugs 2, 3, 4, and 5 provided for the cylinders #1, #2, #3, and #4, respectively. The spark plugs 2, 3, 4, and 5 each include a center electrode to which is applied a sparking voltage from an ignition device 6, and an outer electrode grounded.

The ignition device 6 includes four ignition coils 7, 8, 9 and 10 associated with the spark plugs 2, 3, 4, and 5, for generating sparking voltages to be applied to the spark plugs 2, 3, 4, and 5, respectively. The ignition coils 7, 8, 9 and 10 are each formed of a pair of a primary coil 7*a*, 8*a*, 9*a*, 10*a*, and a secondary coils 7*b*, 8*b*, 9*b*, 10*b*.

The primary coil 7*a* of the ignition coil 7 has one end thereof connected to a storage battery VB and the other end thereof to a collector of a transistor 11. A voltage sensor 20 is arranged at a junction of the other end of the primary coil 7*a* with the collector of the transistor 11 for detecting a primary voltage produced on the primary coil 7*a*. The voltage sensor 20 is connected to the electronic control unit (hereinafter referred to as "the ECU") 15. As the voltage sensor 20, there may be employed e.g. a device which detects an electrostatic capacity changing with the primary voltage on the primary coil 7*a*, and delivers a signal indicative of the primary voltage based on the detected electrostatic capacity, a device using an attenuator, or the like.

On the other hand, the secondary coil 7*b* has one end thereof connected to the one end of the primary coil 7*a* and the other end thereof connected to the center electrode of the spark plug 2.

The other ignition coils 8, 9 and 10 are each constructed and connected to devices associated therewith similarly to the ignition coil 7, with the primary coils 8*a*, 9*a*, and 10*a* of the ignition coils 8, 9, and 10 connected to collectors of respective transistors 12, 13 and 14. However, no sensor corresponding to the voltage sensor 20 is provided between the primary coils 8*a*, 9*a*, and 10*a* and the transistors 12, 13, and 14.

Each of the transistors 11, 12, 13 and 14 has a base supplied with an ignition command signal θ igpn (n=1, . . . , 4) from the ECU 15, and an emitter thereof grounded.

Connected to the ECU 15 are various sensors for detecting engine operating parameters, such as a throttle valve opening (θ TH) sensor 16, a temperature sensor 17, a crank angle (CRK) sensor 18, and a TDC sensor 17. The θ TH sensor 16 detects the opening (throttle valve opening θ TH) of a throttle valve, not shown, arranged in an intake pipe, not shown, of the engine, for supplying an electric signal indicative of the sensed throttle valve opening θ TH to the ECU 15. The temperature sensor 17 includes sensors for detecting temperatures of the engine 1, such as engine coolant temperature and intake air temperature, and supplying electric signals indicative of the sensed engine temperatures to the ECU 15. The CRK sensor 18 generates a CRK signal pulse whenever the crankshaft rotates through a predetermined angle (e.g. 30 degrees) smaller than half a rotation (180 degrees) of a crankshaft, not shown, of the engine 1, while the TDC sensor 19 generates a signal pulse (hereinafter referred to as "the TDC signal pulse") at a top dead center (TDC) position of each of the cylinders #1, #2, #3 and #4 corresponding to the end of a compression stroke thereof whenever the crankshaft rotates through 180 degrees. The CRK signal pulses are used for determining the engine rotational speed NE. That is, time intervals of generation of the CRK signal pulses are measured to calculate CRME values which are added together over a time period of generation of two TDC signal pulses i.e. over a time period of one rotation of the crankshaft to calculate an ME value, and then the engine rotational speed NE, which is the reciprocal of the ME value, is calculated based on the ME value.

The ECU 15 is supplied with a signal indicative of the primary voltage (sparking voltage) on the primary coil 7*a* of the ignition coil 7 from the voltage sensor 20 of the ignition device 6 as well as a signal indicative of an output voltage from the storage battery VB (hereinafter referred to as "the battery voltage VB").

The ECU 5 is comprised of an input circuit 15*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as the "the CPU") 15*b*, a memory device 15*c* storing various operational programs executed by the CPU 15*b*, etc. and for storing results of calculations therefrom, etc., an output circuit 15*d* which outputs driving signals to fuel injection valves 21 provided for the cylinders, respectively, and the ignition command signal θ igpn.

The ECU carries out fuel supply control by calculating a fuel injection period over which fuel should be injected, and supplying a driving signal commensurate with the fuel injection period thus calculated to each fuel injection valve 21, and ignition timing control by calculating ignition timing and supplying the ignition command signal θ igpn based on the ignition timing thus calculated to the ignition device 6.

In the ignition timing control, the ECU 15 calculates ignition timing based on operating conditions of the engine detected by various sensors, and an energization period over which each ignition coil should be energized based on the engine rotational speed NE and the battery voltage VB. Then, the ECU 15 distributes the ignition command signal θ igpn generated based on the ignition timing and the energization period thus calculated to the transistors 11, 12, 13, and 14 to cause them to turn on and off, thereby sequentially igniting an air-fuel mixture in each of the cylinders. Further, the ECU also carries out cylinder-discriminating processing. The cylinder-discriminating processing is carried out by igniting the air-fuel mixture in a particular cylinder (cylinder #1 in the present embodiment) in synchronism with generation of each CRK signal pulse, and detecting the primary voltage of the ignition coil 7 in synchronism with generation of each CRK signal pulse. From the sparking voltage thus detected, it is determined whether the cylinder #1 is in the TDC position at the end of the compression stroke thereof (cylinder discrimination). Hereinafter, the TDC position at the end of the compression stroke of each cylinder will be referred to as "the compression TDC position".

The ignition timing control is carried out by the CPU **15*b* of the ECU 15, which implements ignition timing-calculating means 151, energization period-calculating means 152, distributing means 153, sparking voltage-detecting means 154, and cylinder-discriminating means 155, as shown in FIG. 2**.

Now, ignition waveforms, i.e. waveforms of voltages and currents detected of the primary and secondary coils of the ignition coil which form characteristics of ignition timing control executed by the ECU 15 for the engine will be described with reference to FIGS. 3A to 3E.

In the present embodiment in which the engine is a four-cylinder type, ignition is carried out at the cylinders #1, #3, #4, and #2 in the mentioned-order. When the cylinder #1 is on the compression stroke, the cylinder #3 is on the explosion stroke, the cylinder #4 on the intake stroke, and the cylinder #2 on the exhaust stroke.

Figure 3A:
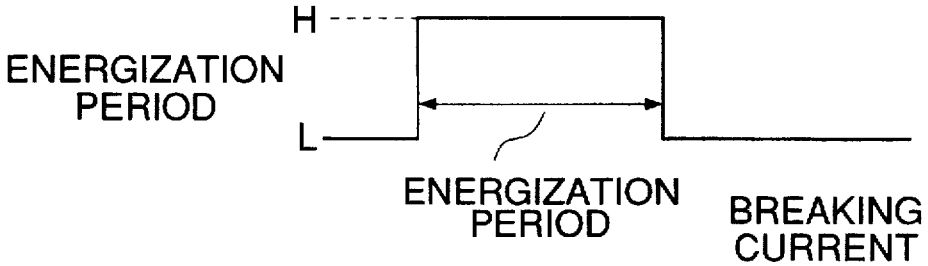
Figure 3B:
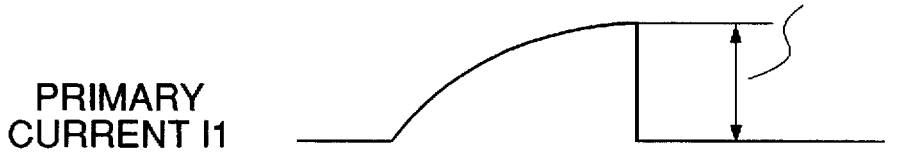
Figure 3C:
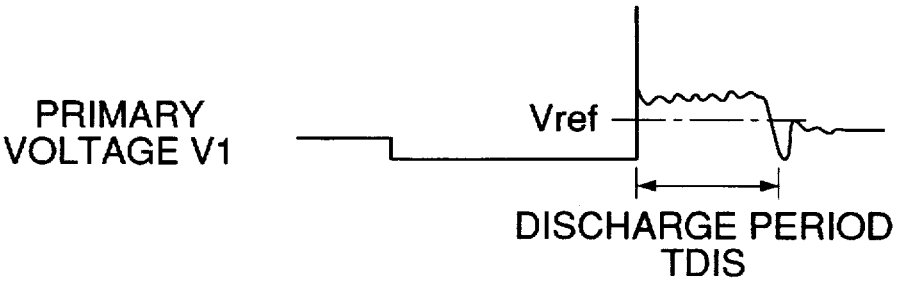
Figure 3D:
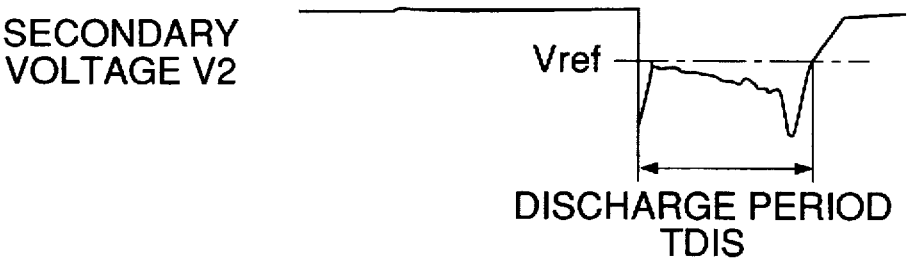
Figure 3E:
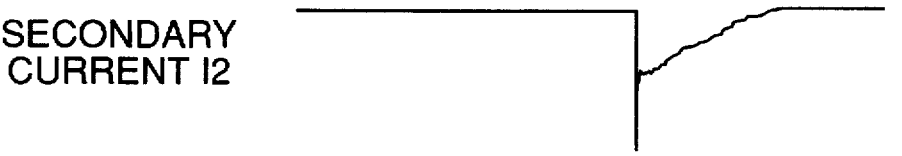

During the ignition timing control, when the ignition command signal θ igpn distributed to the transistors 11, 12, 13, and 14 is at a high level "H", as shown in FIG. 3A, an energized one of the transistors turns on so that the primary current flowing through one of the primary coils **7*a*, 8*a*, 9*a*, and 10*a* of the ignition coils 7, 8, 9, and 10 which is associated with the energized one of the transistors 11, 12, 13, and 14 progressively increases, as shown in FIG. 3B. When a predetermined energization period elapses to change the ignition command signal θ igpn from the high level "H" to a low level "L", the corresponding one of the transistors 11, 12, 13, and 14 turns off to interrupt the primary current I1 flowing through the associated one of the primary coils 7*a*, 8*a*, 9*a*, and 10*a*, as shown in FIG. 3B. The interruption of the primary current I1 causes generation of primary voltage V1 on the primary coil, and a secondary voltage V2 on a corresponding one of the secondary coils 7*b*, 8*b*, 9*b*, and 10*b* and a secondary current I2 flowing through the same. The secondary voltage V2 is applied to the corresponding one of the spark plugs 2, 3, 4, and 5** to cause a discharge between electrodes thereof.

When the discharge occurs between the electrodes of the spark plug 2, 3, 4, or 5 to cause dielectric breakdown of the mixture in the cylinder, the state of discharge shifts from a capacitive discharge state before the dielectric breakdown to an inductive discharge state in which the discharge voltage assumes almost a constant value. The inductive discharge voltage rises with an increase in the pressure within the engine cylinder caused by the compression stroke after production of the secondary voltage (see FIG. 3D), since a higher voltage is required for inductive discharge to occur as the cylinder pressure increases. When the voltage required for the inductive discharge rises, the sparking voltage (secondary voltage) also rises. At the final stage of the inductive discharge, the sparking voltage becomes lower than a value required for the inductive discharge to continue, so that the inductive discharge ceases. The discharge period TDIS is defined as a time period between a time point at which the secondary voltage starts to be produced and a time point at which the inductive discharge ceases. In short, throughout the intake, compression, explosion, and exhaust strokes, the pressure within an engine cylinder becomes the maximum at the top dead center position of the cylinder at the end of the compression stroke thereof, and hence the sparking voltage also becomes the maximum.

From the characteristics of the sparking voltage described above, it is understood that when a cylinder is in the compression TDC position, the sparking voltages (secondary voltage V2 and primary voltage V1) in this cylinder each become the maximum. Further, when the cylinder is in the compression TDC position, the discharge period TDIS (detected of the secondary voltage V2 and primary voltage V1) becomes the minimum, and at the same time the primary current I2 becomes the maximum.

Therefore, based on the fact that the secondary voltage V2 and the primary voltage V1 each become the maximum when any of the cylinders is in its compression TDC position, it is possible to determine whether a particular cylinder is in the compression TDC position, based on a sparking voltage value Vobjn detected as the second voltage or the primary voltage on the ignition coil of the particular cylinder.

Figure 4:
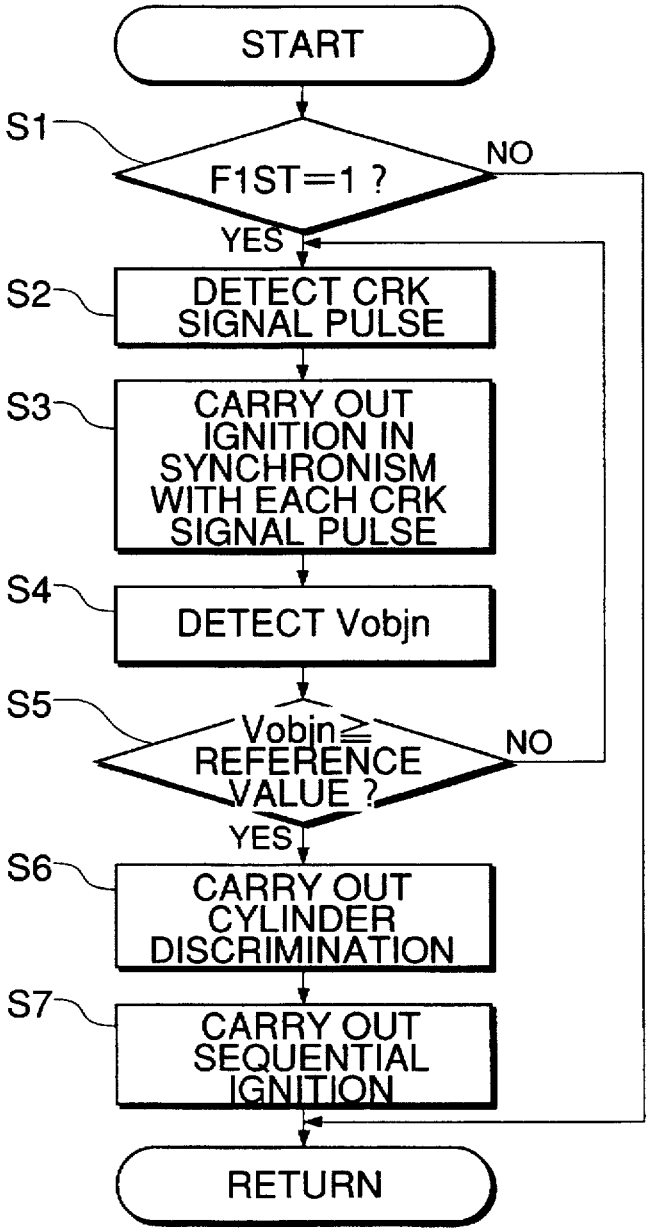
FIG. 4 is a flowchart showing a program for carrying out cylinder-discriminating processing.
Figures 5A, 5B:
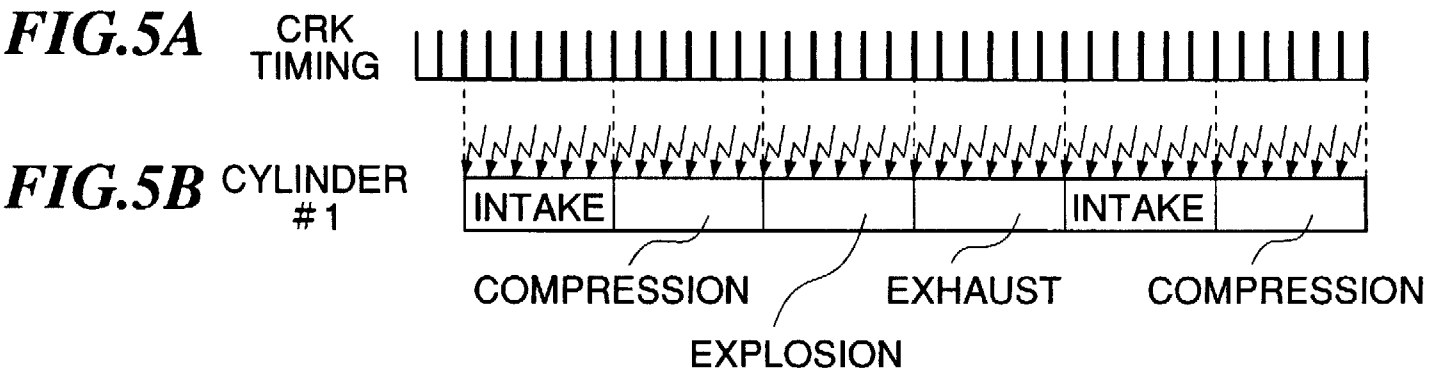

Next, the method of cylinder discrimination according to the present embodiment will be described with reference to FIGS. 4 and 5A, 5B. FIG. 4 shows a program for carrying out the cylinder-discriminating processing executed by the ECU 15, while FIGS. 5A and 5B show timing of ignition of a particular cylinder (cylinder #1) executed in synchronism with generation of each CRK signal pulse (CRK timing).

The cylinder discrimination is carried out when the engine is in a particular operating condition (during fuel cut in which the supply of fuel to the engine 1 is interrupted in a predetermined decelerating condition, including the start of the engine). In other words, when the cylinder discrimination is carried out, fuel injection by the fuel injection valves 21 is not carried out for engine protection purposes.

In the present embodiment, ignition is carried out at the cylinder #1, and based on the resulting sparking voltage, the compression TDC position of the cylinder #1 is determined to thereby discriminate between the cylinders. More specifically, as shown in FIGS. 5A and 5B, during each of the intake, compression, explosion, and exhaust strokes of the cylinder #1, the ignition command signal θ igp1 is delivered to the ignition device 6 whenever the CRK signal pulse is generated, for ignition of the cylinder #1. The primary voltage V1 is detected in synchronism with generation of each CRK signal pulse, i.e. at each time point of the ignition being carried, as the sparking voltage value Vobjn (n=1). The detected sparking voltage value Vobjn is compared with a predetermined reference value Vref, repeatedly if required, until the condition of the sparking Vobjn≧Vref is fulfilled, whereby the compression TDC position of the cylinder #1 is determined to discriminate between the cylinders.

Referring to FIG. 4, first, it is determined at a step S1 whether or not a flag F1ST, which, when set to "1", indicates that the engine is in the particular operating condition, assumes "1". If it is determined that the flag F1ST does not assume "1", the program is immediately terminated, while if it is determined that the flag F1ST assumes "1", the program proceeds to a step S2.

At the step S2, the CRK signal pulse delivered from the CRK sensor 18 is detected, and at the following step S3, the ignition command signal θ igp1 is delivered to the ignition device 6 for ignition of the air-fuel mixture in the cylinder #1 whenever the CRK signal pulse is detected. The ignition command signal θ igp1 produces the sparking voltage on the ignition coil 7, which is applied to the sparking plug 2.

Then, the program proceeds to a step S4, wherein in synchronism with generation of each CRK signal pulse, i.e. each timing of ignition in the cylinder #1, the primary voltage on the primary coil 7 is detected as the sparking voltage value Vobjn (n=1).

At the following step S5, the detected sparking voltage value Vobjn is compared with the predetermined reference value Vref. The predetermined reference value Vref is empirically determined e.g. from results of experiments conducted, based on the fact that the primary voltage becomes the maximum when the cylinder is in the compression TDC position. The predetermined reference value is normally set to a value which is close to a sparking voltage (primary voltage in the present embodiment) to be detected at the compression TDC but lower than the same.

When the condition of Vobjn<Vref is fulfilled, the program returns to the step S2, and the steps S2 to S5 are repeatedly executed until the condition of Vobjn≧Vref is fulfilled.

If the condition of Vobjn≧Vref is fulfilled, the program proceeds to a step S6, wherein it is determined that the time point of generation of the CRK signal pulse at which the condition of Vobjn≧Vref is fulfilled corresponds to the compression TDC position of the cylinder #1. If it is determined that the cylinder #1 is in the compression TDC position at this time point, it is presumed that the cylinders #3, #4, and #2 are on respective predetermined (explosion, intake, and exhaust) strokes, whereby the cylinder discrimination is completed.

At the following step S7, from results of the above cylinder discrimination, sequential ignition of the cylinders is carried out starting with a predetermined cylinder for the next ignition (cylinder #3 in the present embodiment). That is, the sparking command signals θ igpn (n=1, 2, 3 and 4) are sequentially delivered to respective cylinders in a predetermined order, followed by terminating the present program. When the sequential ignition is started, the fuel injection by the fuel injection valves 21 is also started.

It should be noted that the fulfillment of the condition of Vobjn≧Vref takes the maximum time period when the program is started immediately after the end of the compression stroke, which corresponds to approximately four TDC periods.

Thus, according to the present embodiment, when ignition is effected at the cylinder #1 in synchronism with generation of each CRK signal pulse, the primary voltage of the ignition coil 7 is detected as the sparking voltage value Vobjn at a time point of each ignition, and from the detected sparking voltage value Vobjn, the compression TDC position is determined. Therefore, the cylinder discrimination can be effected without using any expensive cylinder-discriminating sensor, such as magnetic, optical, hole, and MRE sensors, which reduces the manufacturing cost.

Further, in the example illustrated in FIGS. 5A and 5B, one of the CRK signal pulses coincides with the compression TDC position of the cylinder #1, which makes it possible to carry out the cylinder discrimination in an even more accurate manner.

Further, since the cylinder discrimination is carried out based on the primary voltage, it is possible to detect the sparking voltage without the cylinder discrimination being adversely affected by noises, whereby it is possible to carry out the cylinder discrimination in a reliable manner.

Still further, if the control system is already provided with a cylinder-discriminating sensor, the cylinder-discriminating device of the present embodiment can be used as a backup of the cylinder-discriminating sensor for failsafe purposes, etc.

Although, according to the present embodiment, the cylinder discrimination is carried out when the engine is in a particular operating condition, e.g. during fuel cut, this is not limitative, but in addition thereto or instead thereof, the cylinder discrimination may be carried by forcibly executing fuel cut at desired timing in dependence on operating conditions of the engine when the need for the cylinder discrimination occurs.

Even further, although in the present embodiment, ignition is carried out whenever each CRK signal pulse is generated, this is not limitative, but instead, it is possible to effect the cylinder discrimination by executing ignition at a reduced frequency, e.g. in synchronism of generation of every other CRK signal pulse.

Moreover, instead of using CRK signal pulses generated at equally-spaced crank angle intervals, the cylinder discrimination can be carried out by executing ignition using CRK signals generated e.g. at unequally-spaced crank angle intervals.

Figure 6:
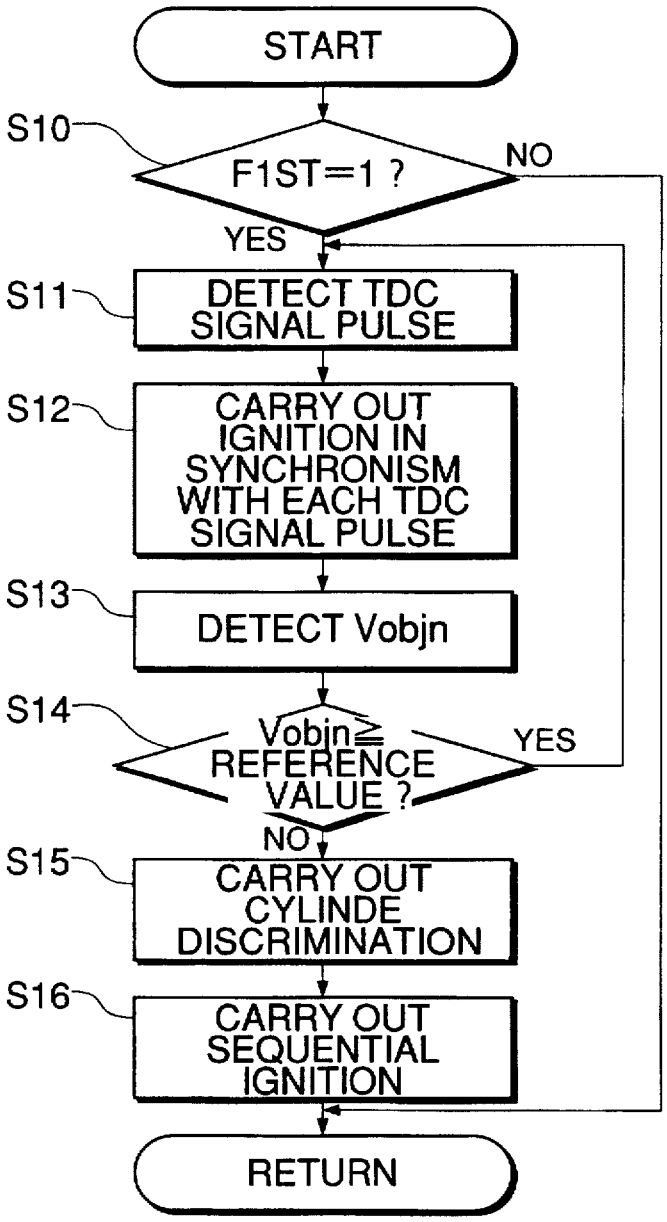
FIG. 6 is a flowchart showing a program for carrying out cylinder-discriminating processing, according to a second embodiment of the invention.
Figure 7:
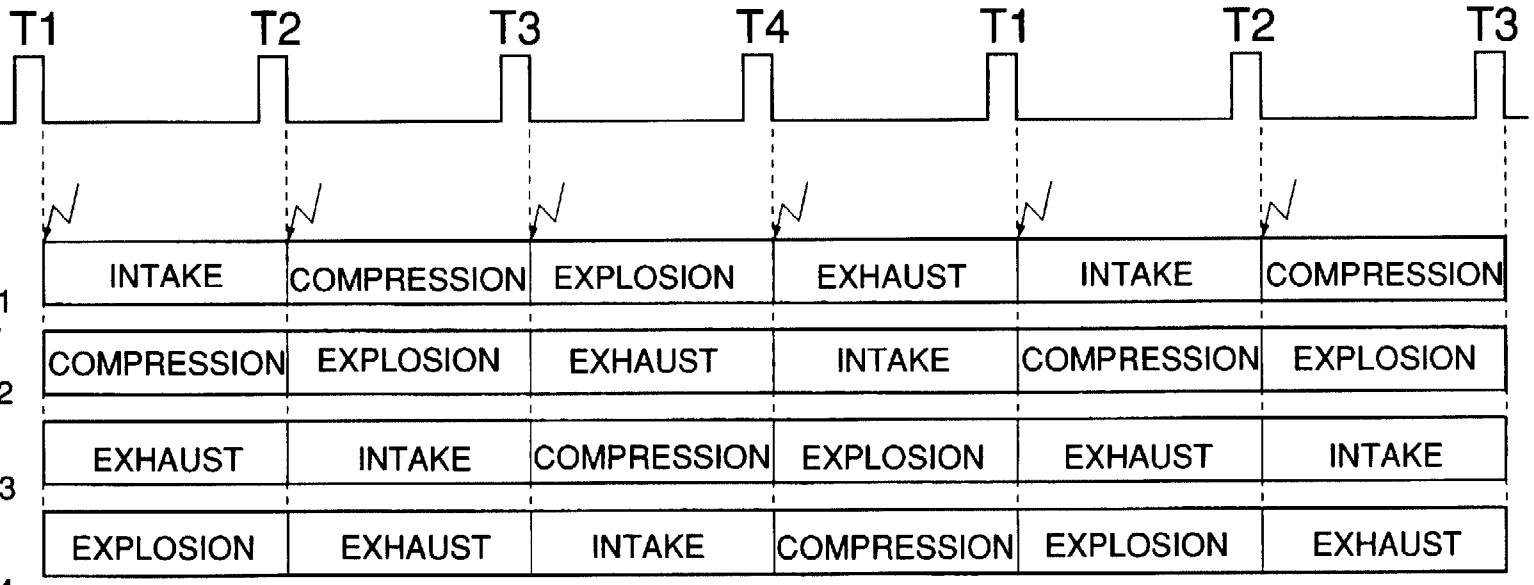

Now, a second embodiment of the invention will be described with reference to FIGS. 6 and 7A to 7E. FIG. 6 shows a program for carrying out cylinder-discriminating processing according to the second embodiment, while FIGS. 7A to 7E show timing of ignition of a particular cylinder (cylinder #1) executed in synchronism with TDC timing, i.e. whenever each TDC signal pulse is generated.

This embodiment is identical in hardware with the first embodiment described above, but distinguished therefrom in that ignition is carried out in synchronism with generation of each TDC signal pulse in place of each CRK signal pulse.

More specifically, as shown in FIGS. 7A to 7E, during each of the intake, compression, explosion, and exhaust strokes of the cylinder #1, the ignition command signal θ igp1 is delivered to the ignition device 6 whenever the TDC signal pulse is generated (at time points T1, T2, T3, and T4 of TDC signal pulse generation) for igniting the air-fuel mixture in the cylinder #1. The resulting primary voltage V1 is detected as the sparking voltage value Vobjn (n=1) in synchronism with generation of each TDC signal pulse, i.e. at a time point of each ignition being carried. The detected sparking voltage value Vobjn is compared with a predetermined reference value Vref, repeatedly if required, until the condition of Vobjn≧Vref is fulfilled, whereby when the condition of Vobjn≧Vref is fulfilled, it is determined that the time point of the TDC signal just generated at the fulfillment corresponds to the compression TDC position of the cylinder #1.

Referring to FIG. 6, first, if it is determined at a step S10 that the flag FIST assumes "1", the program proceeds to a step S11, wherein the TDC signal pulse delivered from the TDC sensor 19 is detected.

Then, the program proceeds to a step S12, wherein the ignition command signal θ igp1 is delivered to the ignition device 6 whenever the TDC signal pulse is detected, for igniting the air-fuel mixture in the cylinder #1.

At the following step S13, in synchronism with generation of each TDC signal pulse, i.e. each timing of ignition in the cylinder #1, the primary voltage V1 of the ignition coil 7 is detected as the sparking voltage Vobjn (n=1).

Then, steps S14 to S16 similar to the steps S5 to S7 in FIG. 4 of the first embodiment are executed, followed by terminating the program.

Thus, according to this embodiment, ignition is effected at the cylinder #1 in synchronism with generation of each TDC signal pulse, and the primary voltage on the ignition coil 7 is detected in synchronism with the ignition timing, whereby the compression TDC position of the cylinder #1 is determined to discriminate between the cylinders. This provides substantially the same advantageous effects as obtained by the first embodiment.

Although in the present embodiment, the detected sparking voltage is compared with the predetermined reference value, this is not limitative, but the cylinder discrimination may be carried out by detecting the sparking voltage on a particular cylinder in synchronism with each TDC signal pulse throughout one cycle of four strokes to obtain four successive values of the sparking voltage on the particular cylinder, and then comparing these values with each other to determine the largest value of them, thereby judging that the sparking voltage with the largest value was caused by ignition effected in synchronism with a TDC signal pulse corresponding to the compression TDC position of the particular cylinder.

Next, a third embodiment of the invention will be described with reference to FIG. 8, which shows the whole arrangement of an internal combustion engine, and a control system including a cylinder-discriminating device according to the third embodiment.

This embodiment is distinguished from the first embodiment, in which the primary voltage on the ignition coil 7 of the particular cylinder (cylinder #1) is detected as the sparking voltage, in that the secondary voltage on the particular cylinder (cylinder #1) is detected as the sparking voltage.

Figure 8:
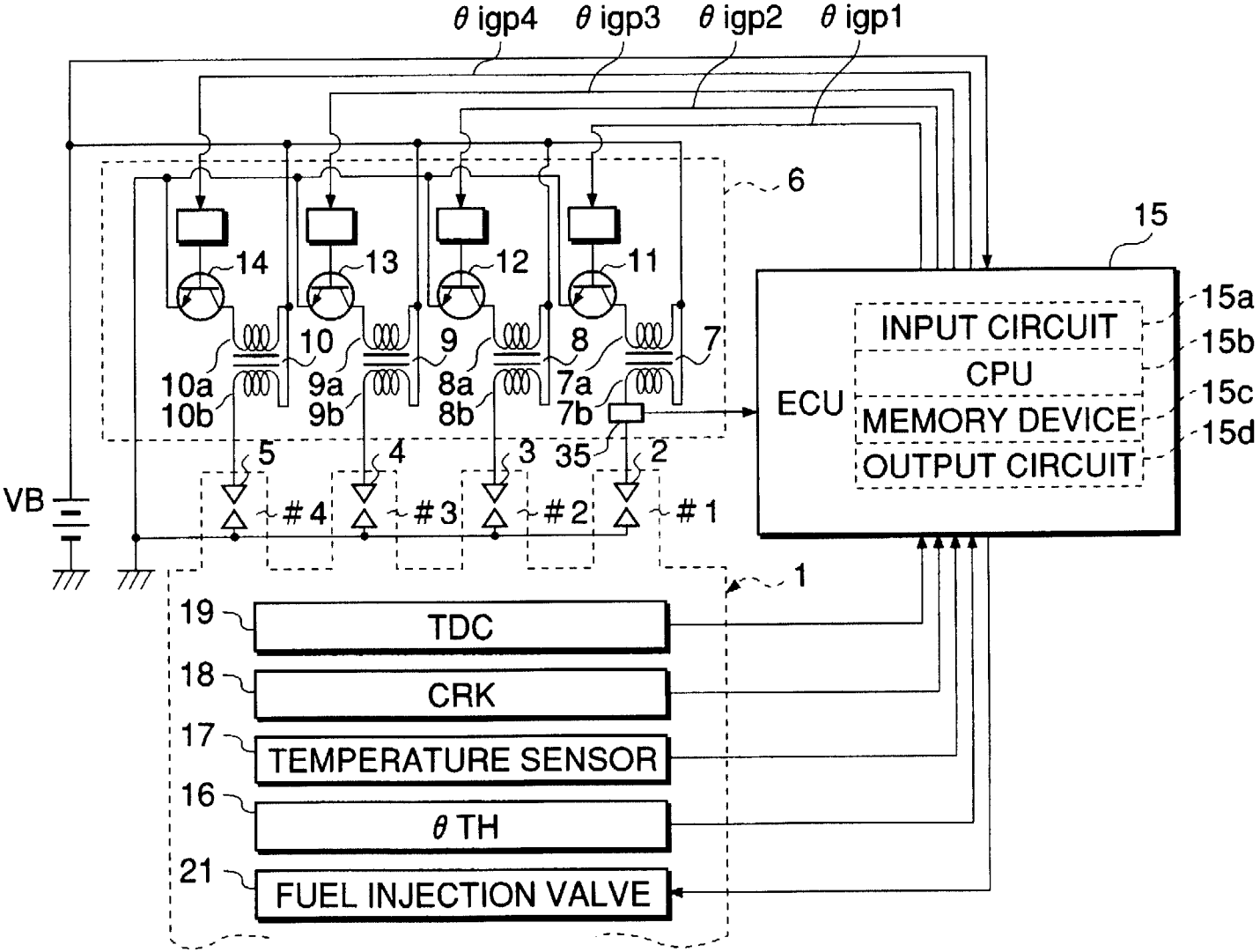
FIG. 8 is a block diagram schematically showing the whole arrangement of an internal combustion engine and a control system therefor incorporating a cylinder-discriminating device according to a third embodiment of the invention.

More specifically, as shown in FIG. 8, a voltage sensor 35 is arranged between the other end of the secondary coil 7*b* of the ignition coil 7 associated with the cylinder #1 and the spark plug 2, for detecting the secondary voltage produced on the secondary coil 7*b*. The voltage sensor 35 may be implemented by any sensor having the same construction as the sensor 20 employed in the first embodiment.

This embodiment carries out cylinder discrimination based on the secondary voltage detected based on the ignition coil associated with the cylinder #1. Details of the manner of cylinder discrimination are identical to those described above as to the first or second embodiment, and hence description thereof is omitted.

Figure 9:
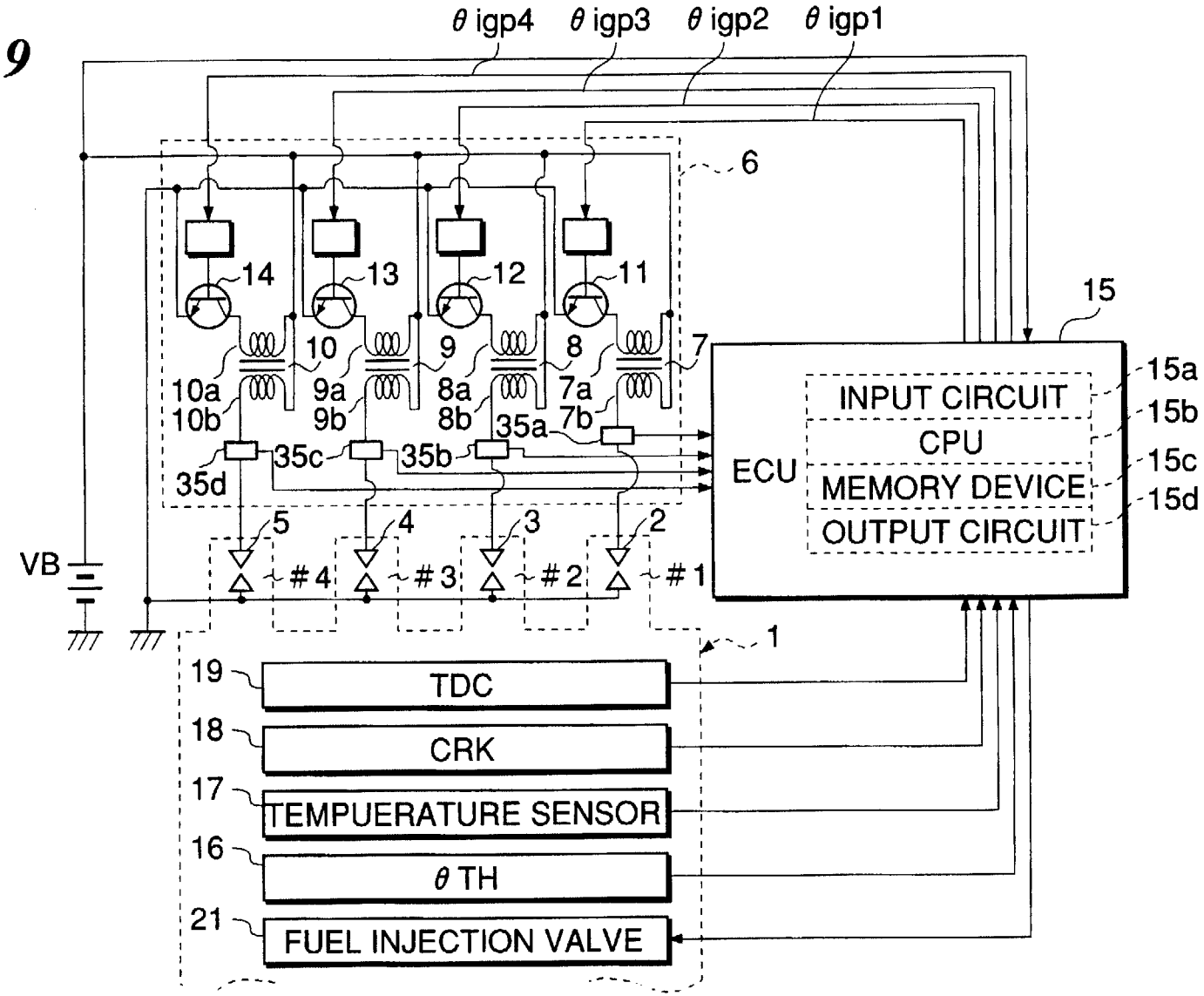
FIG. 9 is a block diagram schematically showing the whole arrangement of an internal combustion engine and a control system therefor incorporating a cylinder-discriminating device according to a fourth embodiment of the invention.
Figure 10:
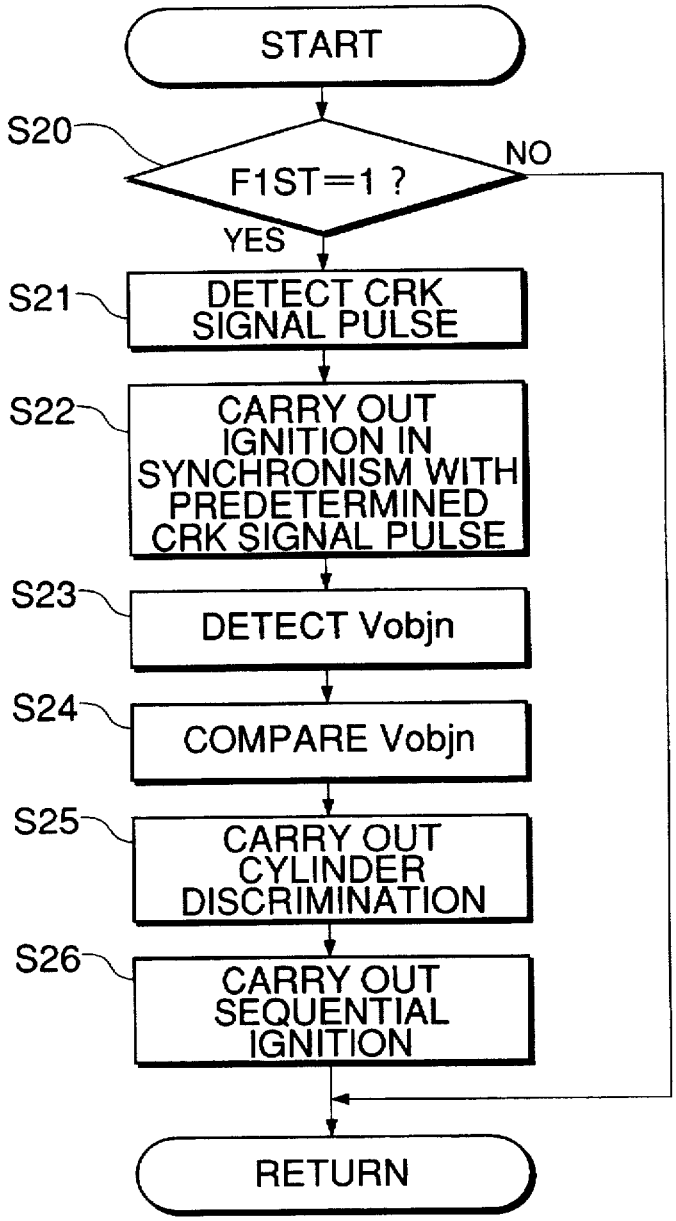
FIG. 10 is a flowchart showing a program for carrying out cylinder-discriminating processing, according to the fourth embodiment.
Figure 11:
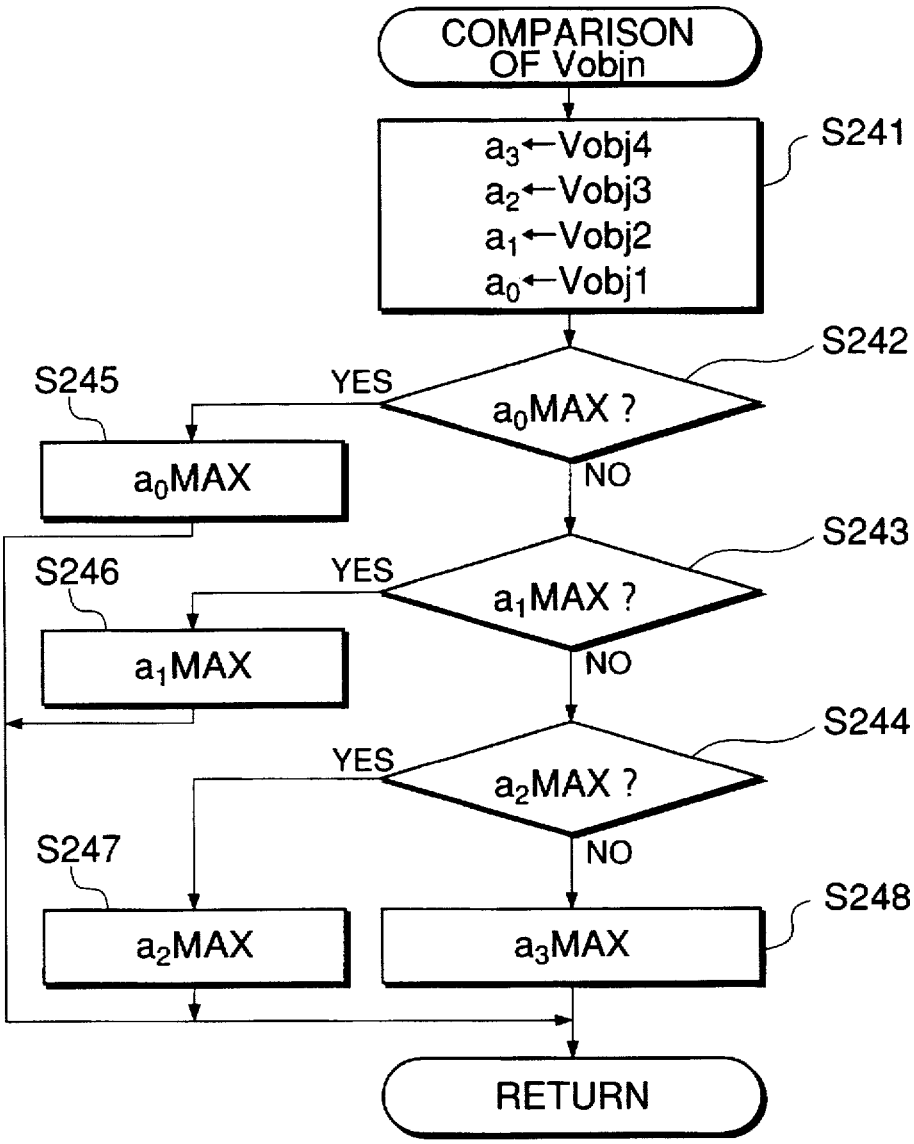
FIG. 11 is a flowchart showing a subroutine for carrying out comparison of Vobjn executed at a step S24 in FIG. 10.
Figures 12A, 12B, 12C, 12D, 12E:
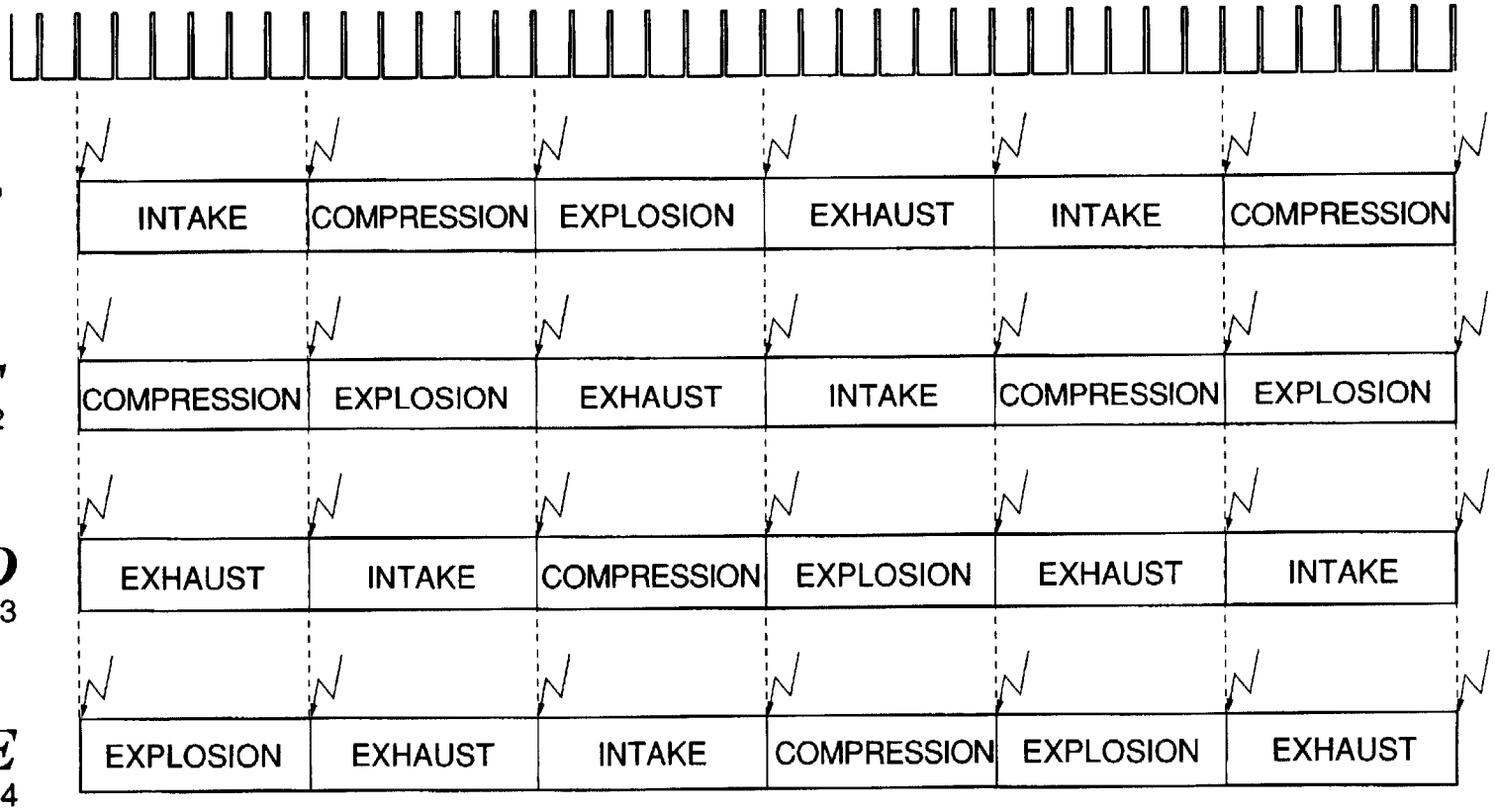

Next, a fourth embodiment of the invention will be described with reference to FIGS. 9 to 12E. FIG. 9 shows the whole arrangement of an internal combustion engine, and a control system therefor including a cylinder-discriminating device according to the fourth embodiment. FIG. 10 shows a program for carrying out cylinder-discriminating processing. FIG. 11 shows a subroutine executed at a step S24 in FIG. 10 for comparison of the sparking voltage values Vobjn with a predetermined value Vref. FIGS. 12A to 12E show timing of ignition of each cylinder executed in synchronism with generation of each of CRK signal pulses at predetermined crank angles.

This embodiment is distinguished from the first embodiment in that ignition is carried out at the cylinders #1, #2, #3, and #4 in synchronism with generation of each of CRK signal pulses at predetermined crank angles, and the secondary voltages on ignition coils associated with respective cylinders, are detected as sparking voltage values Vobjn, based on which the cylinder discrimination is carried out.

In the present embodiment, as shown in FIG. 9, voltage sensors 35*a*, 35*b*, 35*c*, and 35*d* are provided in a fashion corresponding to the cylinders #1, #2, #3, and #4, respectively, for detecting the secondary voltages thereon applied to the ignition plugs 2, 3, 4, and 5. More specifically, the voltage sensor 35*a* is arranged between the other end of the secondary coil 7*b* and the spark plug 2, the voltage sensor 35*b* between the other end of the secondary coil 8*b* and the spark plug 3, the voltage sensor 35*c* between the other end of the secondary coil 9*b* and the spark plug 4, and the voltage sensor 35*d* between the other end of the secondary coil 10*b* and the spark plug 5, while the ECU 15 detects sparking voltage values Vobjn on the secondary coils 7*b*, 8*b*, 9*b*, and 10*b* by way of the voltage sensors 35*a*, 35*b*, 35*c*, and 35*d*, respectively.

Now, the cylinder-discriminating processing according to the present embodiment will be described with reference to FIGS. 10 to 12E.

In the present embodiment, as shown in FIGS. 12A to 12E, in synchronism with generation of each of CRK signal pulses at predetermined crank angles (corresponding to crank angles at the top dead center position and the bottom dead center position of each cylinder), ignition command signals θ igp1, θ igp2, θ igp3, and θ igp4 are delivered to the ignition device 6 for igniting the air-fuel mixture in each of the cylinders, and the resulting secondary voltage V2 is detected at each of the cylinders as a sparking voltage value Vobjn at the same timing. The detected sparking voltage values Vobjn (n=1, 2, 3 and 4) are compared with each other, repeatedly if required, until the compression TDC position of the cylinder #1 is detected.

Referring to FIG. 10, first, it is determined at a step S20 whether or not the flag F1ST indicative of the particular operating condition of the engine assumes "1". If it is determined that the flag F1ST does not assume "1", the program is immediately terminated, while if it is determined that the flag F1ST assumes "1", the program proceeds to a step S21, wherein a CRK signal pulse delivered from the CRK sensor 18 is detected.

Then, at a step S22, ignition command signals θ igp1, θ igp2, θ igp3, and θ igp4 are delivered to the ignition device 6 in synchronism with generation of CRK signal pulses at the predetermined crank angles for igniting the air-fuel mixture in each of the cylinders #1, #2, #3, and #4. More specifically, as shown in FIGS. 12A to 12E, ignition is carried out at each cylinder in synchronism with generation of each CRK signal pulse corresponding to the top dead center position or bottom dead center position of the cylinder.

At the following step S23, the secondary voltages on the ignition coils 7, 8, 9, 10 are detected in synchronism with generation of the CRK signal pulses, i.e. in synchronism with the ignition timing as sparking voltage values Vobjn (n=1, 2, 3, and 4).

Then, the program proceeds to the step S24, wherein the detected Vobjn values are compared with each other. This processing is executed by a subroutine shown in FIG. 11.

First, at a step S241, the detected Vobjn values (n=1, 2, 3 and 4) are written into respective registers a0, a1, a2, and a4 of the memory device 15c of the ECU 15.

Then, at the following step S242, it is determined whether or not the absolute value of the Vobjn value (n=1) stored in the register a0 is the largest value of all the absolute values of the Vobjn values in the registers a0, a1, a2, and a3. If the absolute value of the a0 value is the largest, it is stored as the maximum value a0MAX in a register a0MAX of the memory device 15c at a step S245. Similarly, if it is determined at a step S243 that the absolute value of the a1 value is the largest, this absolute value is stored as the maximum value a1MAX in a register a1MAX of the memory device 15c at a step S246, while if it is determined at a step S244 that the absolute value of the a2 value is the largest, this value is stored as the maximum value a2MAX in a register a2MAX of the memory device 15c at a step S247. If none of the absolute value of the a0 value, the a1 value, and the a2 value are the largest, the absolute value of the a3 value is stored as the maximum value a3MAX in a register a3MAX of the memory device 15c.

Referring again to FIG. 10, at the following step S25, the cylinder discrimination is carried out to determine the compression TDC position of each cylinder based on results of the above comparison. More specifically, if the absolute value of the a0 value is the largest at a time point of ignition timing, the cylinder #1 is determined to be in the compression TDC position at this time point of ignition timing. Similarly, if the absolute value of the a1 value is the largest at a time point of ignition timing, the cylinder #1 is determined to be in the bottom dead center position, i.e. at the end of the explosion stroke (the cylinder #3 is in the compression TDC position) at this time point of the ignition, if the absolute value of the a2 value is the largest, the cylinder #1 is determined to be in the top dead center position at the end of the exhaust stroke (the cylinder #4 is in the compression TDC position), and if the absolute value of the a3 value is the largest, the cylinder #1 is determined to be in the bottom dead center position at the end of the intake stroke (the cylinder #2 is in the compression TDC position). After completion of this determination, each of the registers is cleared.

After completion of the cylinder discrimination at the step 25, the program proceeds to a step S26, wherein the ignition command signal θ igpn (n=1, 2, 3 and 4) is sequentially delivered to the igniting device for sequential ignition of the cylinders in the predetermined order, based on results of the cylinder discrimination, followed by terminating the program.

Thus, according to the present embodiment, ignition is carried out at the cylinders in synchronism with generation of CRK signal pulses at the predetermined crank angles to detect the secondary voltages produced on the ignition coils 7, 8, 9, and 10 as sparking voltage values Vobjn at the ignition timing of the cylinders, respectively, and based on results of the comparison of the Vobjn values, the cylinder discrimination is carried out. Therefore, in addition to the advantageous effects obtained in the above first to third embodiments, it is possible to reduce time required for the cylinder discrimination.

Although in the present embodiment, the compression TDC position of each cylinder is determined, this is not limitative, but instead of this, the explosion bottom dead center position at the end of the explosion stroke, the top dead center position at the end of the exhaust stroke, or the bottom dead center position at the end of the intake stroke may be determined.

Further, although in the present embodiment, ignition is carried out in synchronism with generation of CRK signal pulses corresponding to crank angle positions of the top dead center position and the bottom dead center position of each cylinder, this is not limitative, but it is possible to carry out ignition of the cylinders in synchronism with generation of each CRK signal pulse.

Still further, in the present embodiment, the secondary voltage on each of the cylinders (#1, #2, #3, and #4) is detected as the sparking voltage, this is not limitative, but it goes without saying that primary voltage of each cylinder may be detected and employed as the sparking voltage, and the cylinder discrimination can be carried out based on results of the detected sparking voltage values.

Figure 13:
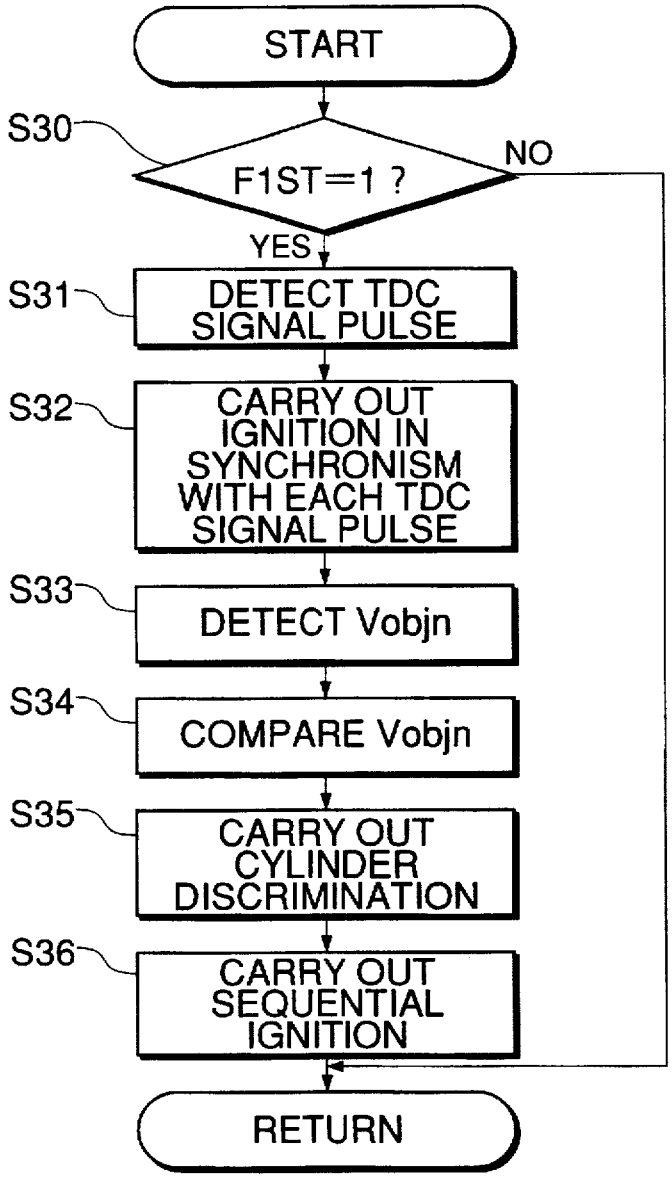
FIG. 13 is a flowchart showing a program for carrying out cylinder-discriminating processing, according to a fifth embodiment of the invention.
Figure 14:
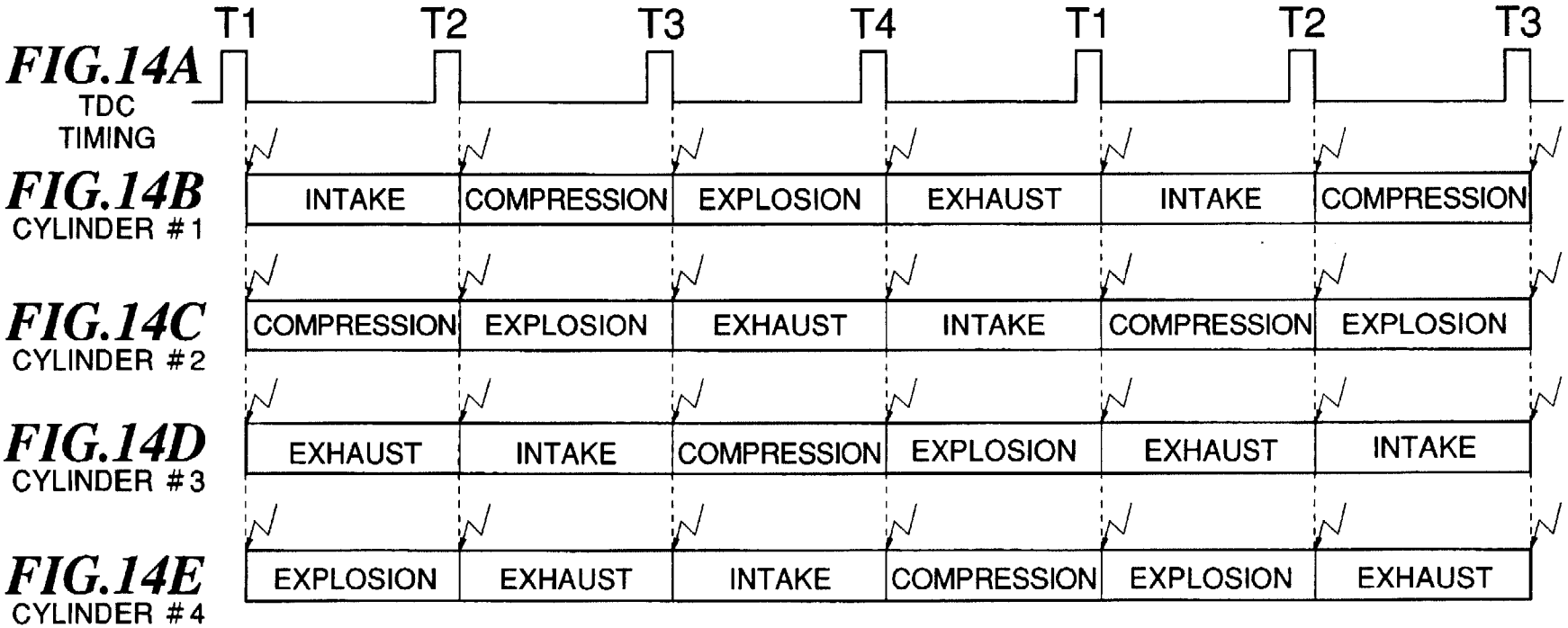

Next, a fifth embodiment of the invention will be described with reference to FIGS. 13 and 14A to 14E. FIG. 13 shows a program for carrying out cylinder-discriminating processing according to the fifth embodiment. FIG. 14 shows timing of ignition carried out at each cylinder in synchronism with generation of each TDC signal pulse.

This embodiment is identical in hardware with the fourth embodiment described above, but distinguished therefrom in that ignition is carried out at each cylinder in synchronism with generation of each TDC signal pulse, instead of CRK signal pulses, to thereby detect the secondary voltages produced on ignition coils associated with the cylinders at the ignition timing, as respective sparking voltage values Vobjn. The cylinder discrimination is carried out based on results of a comparison between the sparking voltage values Vobjn.

More specifically, as shown in FIG. 14, ignition command signals θ igp1, θ igp2, θ igp3, and θ igp4 are delivered to the ignition device 6 whenever a TDC signal pulse is generated (at time points T1, T2, T3, and T4 of TDC signal pulse generation) for igniting the air-fuel mixture in each cylinder. The secondary voltages V2 on the ignition coils are detected in synchronism with generation of each TDC signal pulse, i.e. in synchronism with each ignition, as the sparking voltage values Vobjn (n=1, 2, 3 and 4). The detected sparking voltage values Vobjn are compared with each other, and based on results of the comparison, the cylinder discrimination is carried out.

Referring to FIG. 13, first, it is determined at a step S30 whether or not the flag F1ST assumes "1". If it is determined that the flag F1ST does not assume "1", the program is immediately terminated, whereas if it is determined that the flag F1ST assumes "1", the program proceeds to a step S31, wherein a TDC signal pulse delivered from the TDC sensor 19 is detected.

Then, the program proceeds to a step S32, wherein the ignition command signals θ igp1, θ igp2, θ igp3, and θ igp4 are delivered to the ignition device 6 in synchronism with the detection of each TDC signal pulse (at time points T1, T2, T3, and T4 of TDC signal pulse generation in FIG. 13) for igniting the air-fuel mixture in each cylinder.

At the following step S33, in synchronism with generation of each TDC signal pulse, i.e. in synchronism with ignition carried out at the cylinders, the secondary voltages developed on the ignition coils 7, 8, 9, and 10 are detected as the sparking voltage values Vobjn (n=1, 2, 3 and 4).

Then, the program proceeds to a step S34, wherein the detected Vobjn values are compared with each other. This comparison processing is identical to that described above with reference to FIG. 11 of the fourth embodiment, and hence description thereof is omitted.

At the following step S35, from results of the comparison executed at the step S34, it is determined which of the cylinder is in the compression TDC position, to thereby discriminate between the cylinders. This manner of determination is identical to that of the fourth embodiment described above, and hence description thereof is omitted.

Then, the program proceeds to a step S36, wherein the ignition command signal θ igpn (n=1, 2, 3 and 4) is delivered to execute sequential ignition of the cylinders in the predetermined order, followed by terminating the processing.

Thus, according to this embodiment, ignition is carried out at the cylinders in synchronism with generation of each TDC signal pulse, and the secondary voltages produced on the ignition coils 7, 8, 9, and 10 are detected at the ignition timing as the sparking voltage values Vobjn of the cylinders, and compared with each other. Based on results of the comparison, cylinder discrimination is carried out. This provides substantially the same advantageous effects as obtained by the fourth embodiment.

Figure 15:
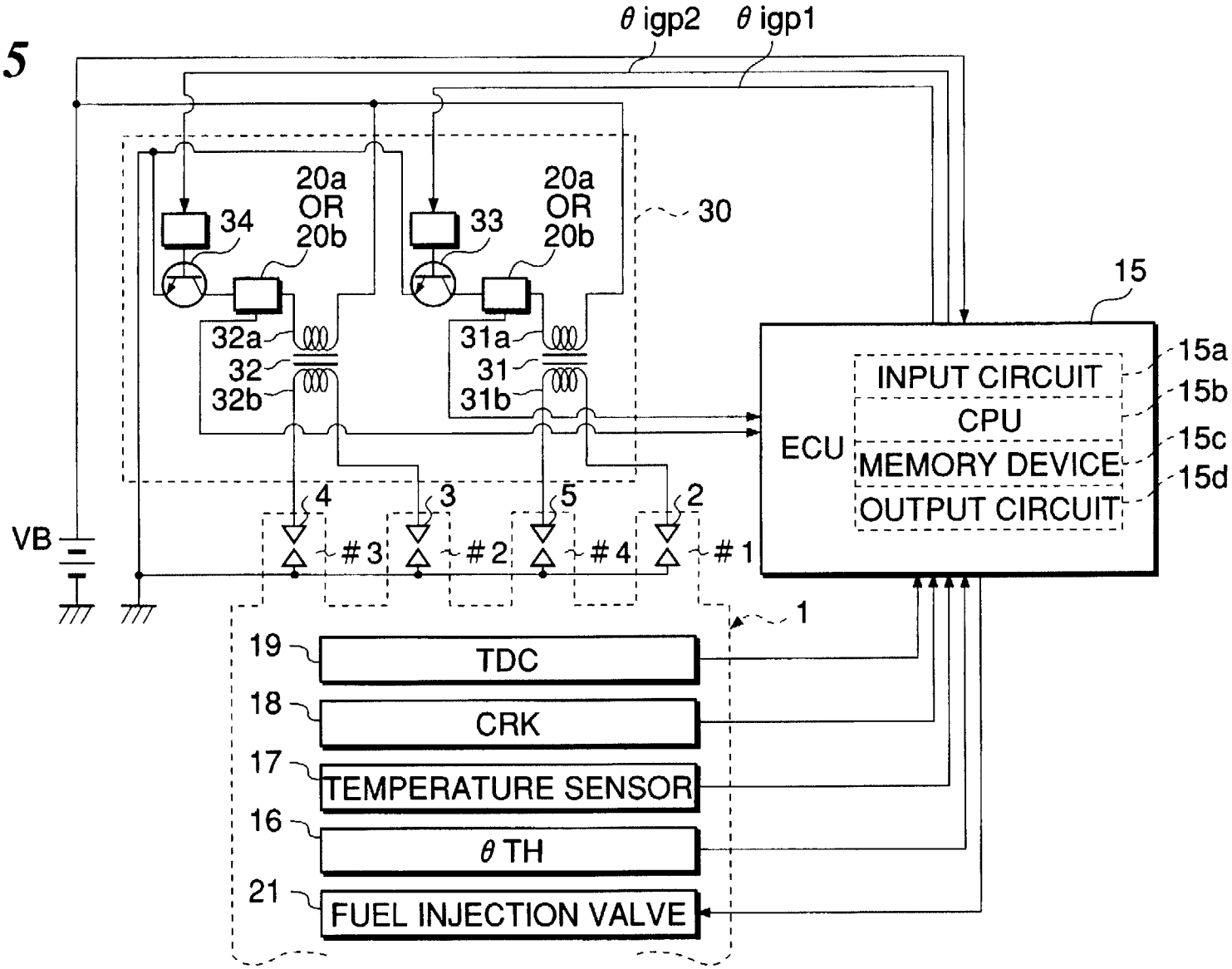
FIG. 15 is a block diagram schematically showing the whole arrangement of an internal combustion engine and a control system therefor incorporating a cylinder-discriminating device according to a sixth embodiment of the invention.

Next, a sixth embodiment of the invention will be described with reference to FIGS. 15 and 16. FIG. 15 shows the whole arrangement of an internal combustion engine, and a control system therefor including a cylinder-discriminating device according to the sixth embodiment. In the present embodiment, the cylinder-discriminating device of the invention is applied to an internal combustion engine provided with an ignition device in which one ignition coil is provided for each pair of spark plugs associated with two cylinders, and ignition is carried out simultaneously at the two cylinders.

As shown in FIG. 15, the engine 1 has four cylinders #1, #2, #3, and #4, and spark plugs 2, 3, 4, and 5 are provided for the four cylinders #1, #2, #3, and #4, respectively. Each of the four spark plugs 2, 3, 4, and 5 has a center electrode to which a sparking voltage is applied by an ignition device 30, and an outer electrode grounded. The spark plugs 2 and 5 are grouped for a first group of cylinders, i.e. the cylinders #1 and #4, and the spark plugs 3 and 4 for a second group of cylinders, i.e. the cylinders #2 and #3.

The ignition device 30 has two ignition coils 31, 32 provided for the first and second groups of cylinders, respectively, to generate a sparking voltage for carrying out simultaneous ignition of the pair of cylinders of each of the two groups. The ignition coil 31 is comprised of a primary coil 31*a*, and a secondary coil 31*b*, and the ignition coil 32 a primary coil 32*a*, and a secondary coil 32*b*.

The primary coil 31*a* of the ignition coil 31 has one end thereof connected to a storage battery VB and the other end thereof connected to a collector of a transistor 33. A voltage sensor 20*a* is arranged at a junction of the other end of the primary coil 31*a* with the collector of the transistor 33 for detecting a primary voltage produced on the primary coil 31*a*. The voltage sensor 20*a* is electrically connected to the ECU 15. On the other hand, the secondary coil 31*b* has one end thereof connected to the center electrode of the spark plug 2 and the other end thereof to the center electrode of the spark plug 5.

The ignition coil 32 is constructed and connected to devices associated therewith similarly to the ignition coil 31, with the primary coil 32*a* of the ignition coil 32 connected to a collector of a transistor 34, and a voltage sensor 20*b* arranged at a junction of the primary coil 32*a* of the ignition coil 32 with the collector of the transistor 34. The voltage sensor 20*b* is electrically connected to the ECU 15. The voltage sensors 20*a*, 20*b* have the same construction as the voltage sensor 24 of the first embodiment described above.

The transistors 33, 34 each have a base thereof supplied with an ignition command signal θ igpn (n=1, 2), and an emitter thereof grounded.

The ECU 15 is supplied with a signal indicative of the primary voltage produced on the primary coil 31*a* of the ignition coil 31 from the voltage sensor 20*a*, and a signal indicative of the primary voltage produced on the primary coil 32*a* of the ignition coil 32 from the voltage sensor 20*b*.

In the ignition timing control, the ECU 15 calculates ignition timing based on operating conditions of the engine detected by various sensors, and an energization period over which each ignition coil should be energized, based on the engine rotational speed NE and the battery voltage VB, then distributes ignition command signals θ igpn dependent on the ignition timing and the energization period thus calculated alternately to the transistors 33, and 34, to thereby cause the transistors to turn on and off for simultaneous ignition of the two cylinders of each cylinder group. Further, the ECU 15 carries out cylinder discrimination, by carrying out ignition of the cylinders of each cylinder group in synchronism with generation of each TDC signal pulse, to detect the primary voltages on the ignition coils 31, 32. Based on the detected primary voltages, one cylinder group is discriminated from the other.

The remainder of the construction of the present embodiment is similar to that of one of the above described embodiments, and hence description thereof is omitted.

Now, cylinder-discriminating processing according to the present embodiment will be described with reference to FIG. 16.

Figure 16:
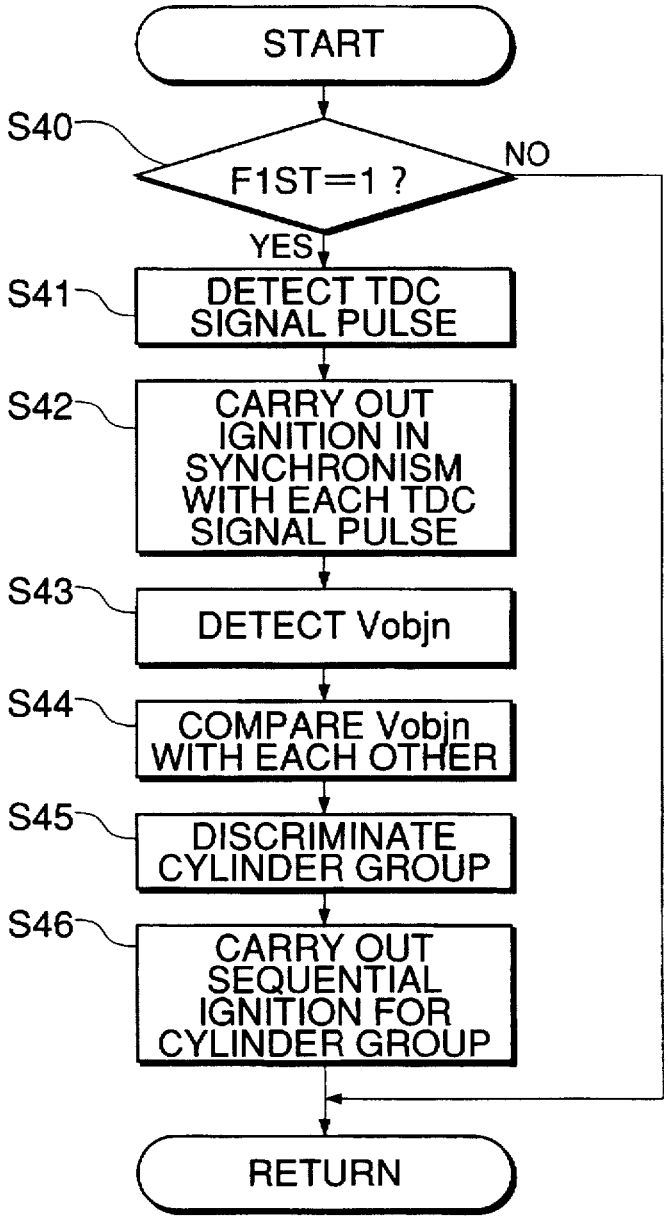
FIG. 16 is a flowchart showing a program for carrying out cylinder-discriminating processing, according to the sixth embodiment.

In FIG. 16, first, it is determined at a step S40 whether or not the flag F1ST assumes "1". If it is determined that the flag F1ST assume "1", the program proceeds to a step S41, wherein whether a TDC signal pulse delivered from the TDC sensor 19 is detected.

Then, the program proceeds to a step S42, wherein ignition command signals θ igp1 and θ igp2 are delivered to the ignition device 30 whenever each TDC signal pulse is detected to carry out ignition for each cylinder group. Thus, the ignition command signals θ igp1, θ igp2 are simultaneously generated in synchronism with generation of TDC signal pulses to cause generation of sparking voltages on the respective ignition coils 31, 32, which are applied to the spark plugs 2, 5, of the first cylinder group and ones 3, 4 of the second cylinder group, respectively.

At the following step S43, in synchronism with generation of each TDC signal pulse, i.e. at the ignition timing of the cylinder groups, the primary voltages of the ignition coil 31, 32 are detected as sparking voltage values Vobjn (n=1, 2) corresponding to the cylinder groups.

Then, the program proceeds to a step S44, wherein the detected sparking voltage values Vobjn of the cylinder groups are compared with each other.

At the following step S45, the cylinder discrimination is carried out based on the results of the comparison executed at the step S44 to determine the compression TDC position of each cylinder group. More specifically, if the condition of Vobj1≧Vobj2 is fulfilled, it is determined that the first cylinder group, i.e. the cylinder #1 or the cylinder #4, is in the compression TDC position, whereas if the condition of Vobj2 <Vobj1 is fulfilled, it is determined that the second cylinder group, i.e. the cylinder #2 or the cylinder #3, is in the compression TDC position. Thus, determination of the compression TDC position of each cylinder group, i.e. the cylinder group discrimination is effected.

At the following step S46, based on results of the above cylinder group discrimination, the ignition command signals θ igpn (n=1, 2) are sequentially delivered to respective cylinder groups in a predetermined order depending upon results of the cylinder group discrimination, to execute sequential ignition of the cylinder groups, followed by terminating the present program.

As described above, according to the present embodiment, cylinder group ignition is carried out in synchronism with generation of each TDC signal pulse, and primary voltages of the ignition coils 31, 32 are detected as sparking voltage values Vobjn for the cylinder groups, respectively. Then, through comparison of the detected sparking voltage values Vobjn with each other, one cylinder group is discriminated from the other. Therefore, detection of two voltages is sufficient for the cylinder discrimination as to the four cylinders, which simplifies the construction of the cylinder-discriminating device.

Further, since a primary voltage is detected for each cylinder group, a time period corresponding to two TDC periods is sufficient for completing the cylinder discrimination.

Although in the present embodiment, the primary voltages on the ignition coils 31, 32 are detected as sparking voltage values Vobjn for the respective cylinder groups, this is not limitative, but instead, the secondary voltages on the ignition coils 31, 32 may be detected as the sparking voltage values Vobjn for the respective cylinder groups.

Still further, the cylinder group discrimination may be effected by detecting a value of the primary or secondary voltage of one of the cylinder groups, and comparing the detected primary or secondary voltage value with a predetermined reference value, or alternatively by detecting two successive values of the primary or secondary voltage of one of the cylinder groups and comparing the two values with each other.

Figure 17:
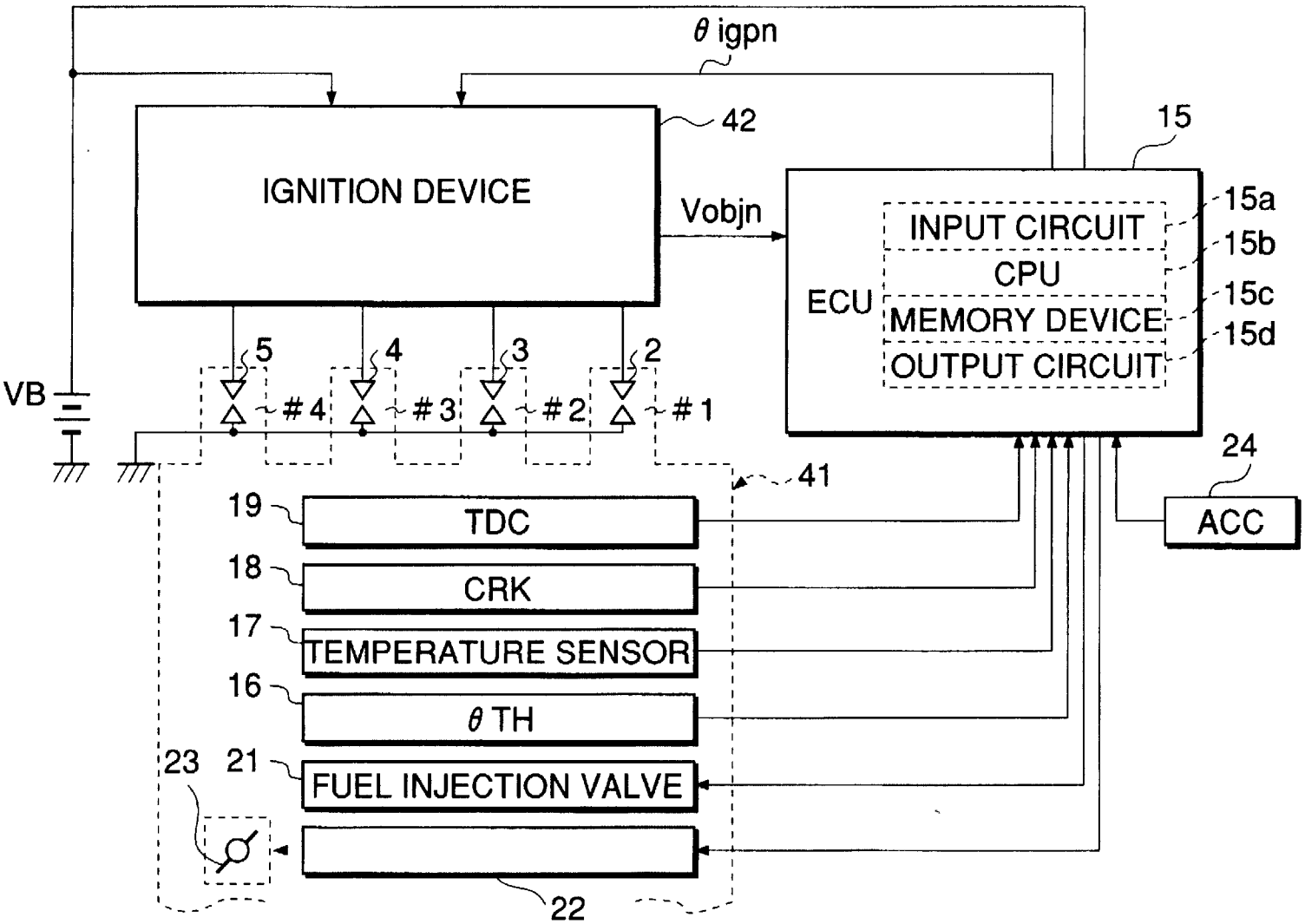
FIG. 17 is a block diagram schematically showing the whole arrangement of an internal combustion engine and a control system therefor incorporating a cylinder-discriminating device according to a seventh embodiment of the invention.

Next, a seventh embodiment of the invention will be described with reference to FIGS. 17 to 19. FIG. 17 shows the whole arrangement of an internal combustion engine, and a control system including a cylinder-discriminating device according to the seventh embodiment. In the present embodiment, the cylinder-discriminating device of the invention is applied to an internal combustion engine 41 equipped with an electronically-controlled throttle valve.

As shown in FIG. 17, the engine 41 has an actuator 22 connected to a throttle valve 23 for actuating the same, and electrically connected to an ECU 15.

Connected to the ECU 15 are a throttle valve opening (θ TH) sensor 16, a temperature sensor 17, a crank angle (CRK) sensor 18, a TDC sensor 19, as well as an accelerator opening (ACC) sensor 24 for detecting an accelerator pedal travel exerted by a driver (hereinafter referred to as "accelerator opening") ACC, etc.

The ECU 15 supplies a driving signal responsive to the accelerator opening ACC detected by the ACC sensor 24 to drive the actuator 22 for control of the opening of the throttle valve 23.

The remainder of the construction of the present embodiment is similar to that of one of the above embodiments, and hence description thereof is omitted. Further, in cylinder discrimination involved in ignition timing control by the ECU 15, the compression TDC position of a particular cylinder (or each cylinder or cylinder group) is determined in a manner dependent on the voltage-detecting arrangement of an ignition device 42 for detecting sparking voltages on ignition coils, but detailed description of a manner of the determination is omitted, since it is similar to one of those described above.

Next, a manner of throttle valve opening control required by the cylinder discrimination will be described with reference to FIGS. 18 and 19. FIG. 18 shows a program for carrying out throttle valve opening control required by cylinder discrimination at the start of the engine, while FIG. 19 shows a program for carrying out throttle valve opening control required after unsuccessful cylinder discrimination.

First, the manner of throttle valve opening control required by the cylinder discrimination at the start of the engine will be described with reference to FIG. 18.

In the present embodiment, when the engine is started, the cylinder discrimination is carried out in a manner employed by one of the above described embodiments, and the throttle valve opening control required thereby is also carried out at the same time.

Figure 18:
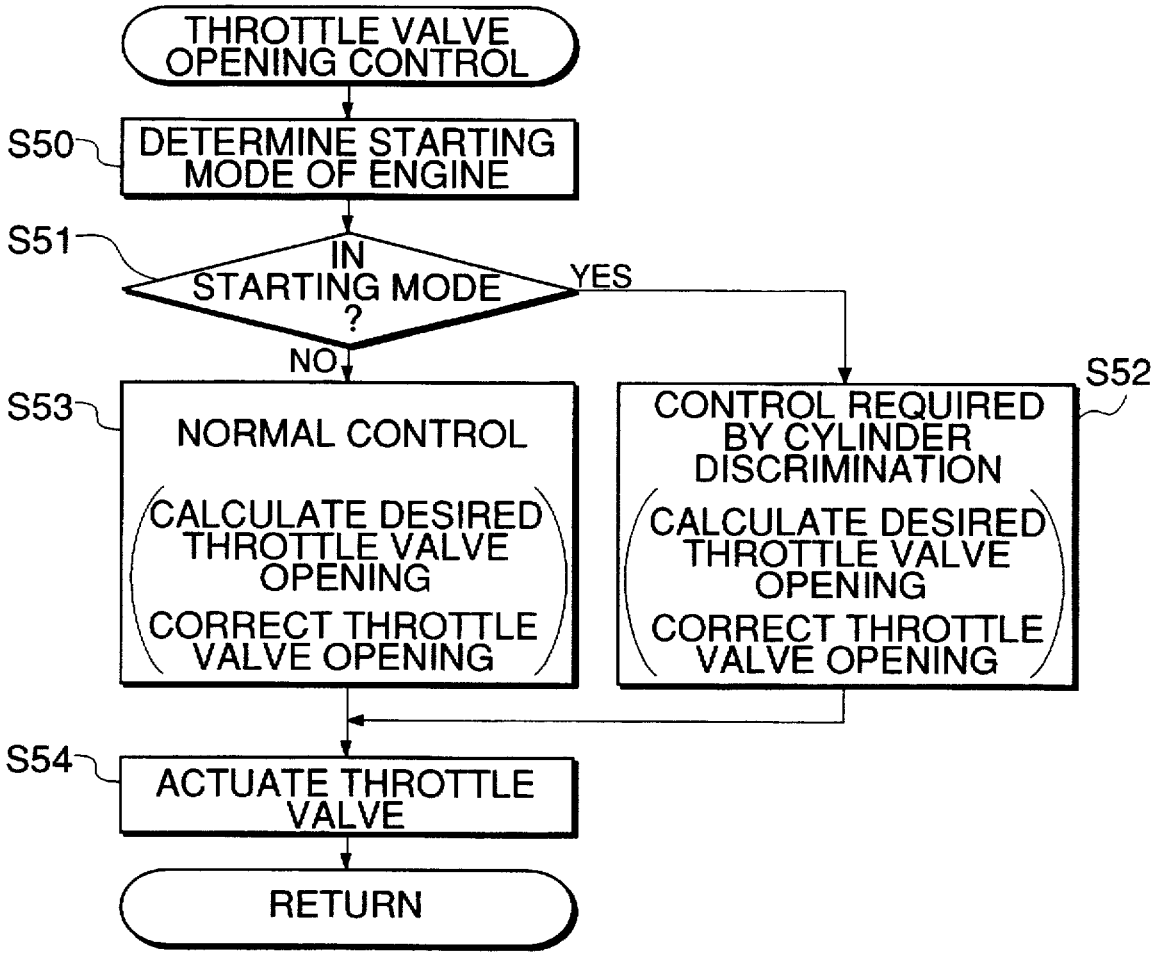
FIG. 18 is a flowchart showing a program for carrying out throttle valve opening control required by cylinder discrimination at the start of the engine.
Figure 19:
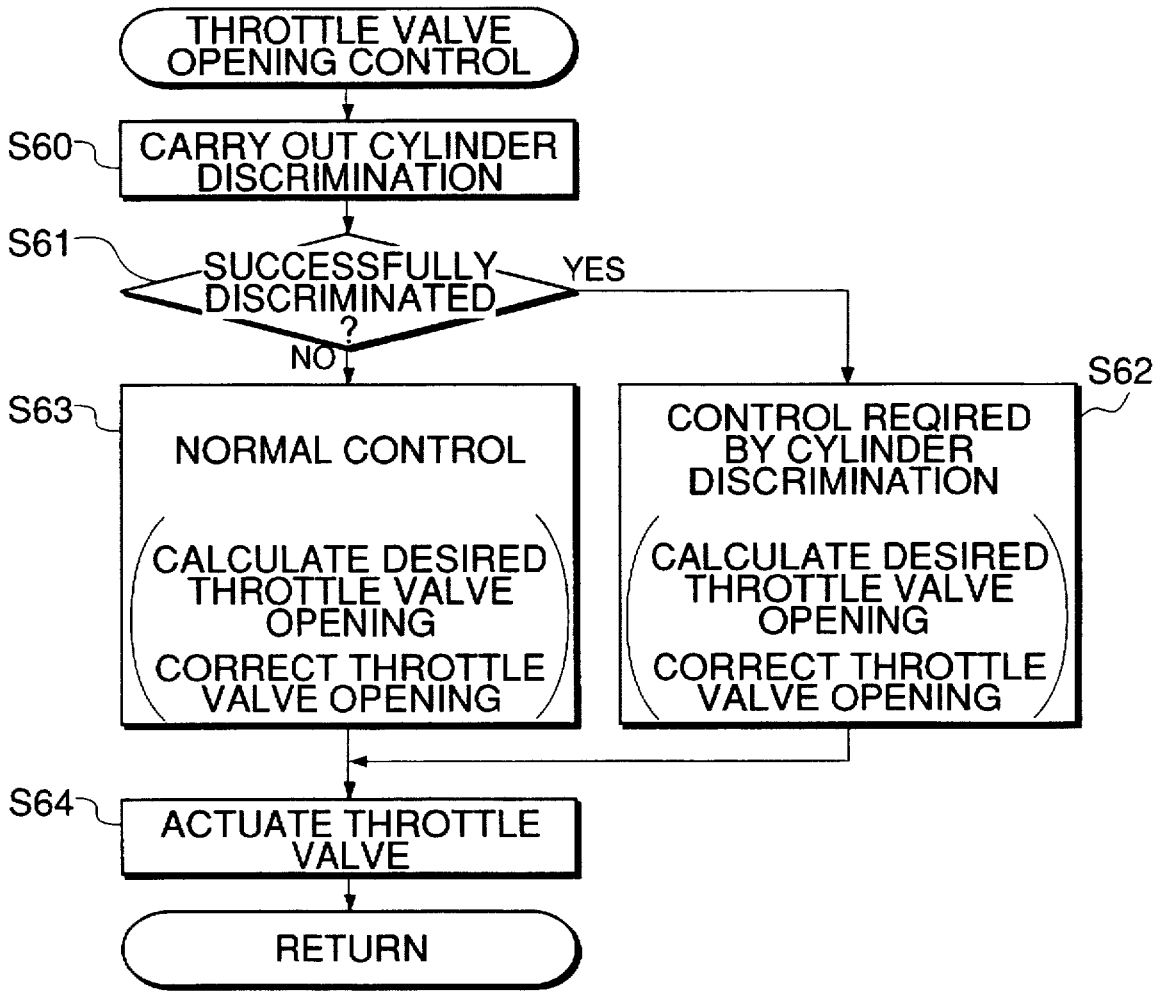
FIG. 19 is a flowchart showing a program for carrying out throttle valve opening control required after unsuccessful cylinder discrimination.

Referring to FIG. 18, first, at a step S50, it is determined whether or not the engine is in a starting mode, and then at a step S51 it is determined whether or not results of the determination at the step S50 show that the engine is in the starting mode.

If it is determined at the step S51 that the engine is in the starting mode, the program proceeds to a step S52, wherein throttle valve opening control required by the cylinder discrimination is carried out. In this control, irrespective of the accelerator opening ACC, a desired valve opening value of the throttle valve 23 suitable for the starting mode is calculated, and then the calculated desired valve opening value is corrected depending on the temperature of the engine. Thus, by the throttle valve opening control required by the cylinder discrimination at the start of the engine holds the throttle valve 23 is held at a predetermined opening suitable for the starting mode of the engine irrespective of the accelerator opening ACC.

After calculating the desired valve opening value of the throttle valve 23, the program proceeds to a step S54, wherein the throttle valve 23 is actuated by the actuator 23 such that the opening of the throttle valve 23 becomes equal to the calculated throttle valve opening value, followed by terminating the program.

On the other hand, if it is determined at the step S51 that the engine is not in the starting mode, the program proceeds to a step S53 to start normal throttle valve opening control, in which a desired valve opening value of the throttle valve 23 corresponding to the accelerator opening ACC is calculated, and the calculated value is corrected depending on the temperature of the engine.

After calculating the desired valve opening value of the throttle valve 23, the program proceeds to a step S54, wherein the throttle valve 23 is actuated by the actuator 22 such that the opening of the throttle valve 23 becomes equal to the desired valve opening value calculated as above, followed by terminating the program.

Next, when the engine is in a particular operating condition (predetermined decelerating condition), cylinder discrimination is carried out in a manner employed by one of the above described embodiments. If the cylinder discrimination has not been successfully carried out, throttle valve opening control required after the unsuccessful cylinder discrimination is executed. This throttle valve opening control is for making conditions of intake air in each cylinder suitable for successful cylinder discrimination, through adjustment of the amount of intake air drawn into the cylinder by controlling the opening of the throttle valve 22.

This valve opening control will be described with reference to FIG. 19. First, at a step S60, the cylinder discrimination is carried out, and at the following step S61, it is determined whether or not the cylinder discrimination has been successfully carried out to determine the compression TDC position of a particular cylinder (or each cylinder or cylinder group). This determination of the successful cylinder discrimination can be carried out in synchronism with generation of TDC signal pulses according to the maximum time period required for cylinder discrimination which is carried out in a manner employed by one of the above described embodiments, e.g. once for every four TDC periods at the maximum.

If it is determined that the cylinder discrimination has not been successfully carried out, the program proceeds to a step S62, wherein throttle valve opening control required after the unsuccessful cylinder discrimination is started. In this throttle valve opening control, irrespective of the accelerator opening ACC, a desired valve opening value of the throttle valve 23 suitable for successful cylinder discrimination is calculated, and the calculated value is corrected in dependence on the temperature of the engine.

After calculating the desired valve opening value of the throttle valve 23 at the step S62, the program proceeds to a step S64, wherein the throttle valve 23 is actuated by the actuator 22 such that the opening of throttle valve 23 becomes equal to the desired valve opening value, followed by terminating the program.

On the other hand, if it is determined at the step S61 that the cylinder discrimination has been successfully carried out, the program proceeds to a step S63, wherein normal throttle valve opening control is started. In this normal throttle valve opening control, a desired valve opening value of the throttle valve 23 is calculated, and the calculated value is corrected in dependence on the temperature of the engine.

After calculating the desired valve opening value of the throttle valve 23, the throttle valve 23 is actuated by the actuator 22 such that the opening of the throttle valve 23 becomes equal to the desired valve opening value, followed by terminating the program.

Thus, according to the present embodiment, which is applied to an internal combustion engine equipped with an electronically-controlled throttle valve, when the engine is started, throttle valve opening control shifts to a mode required by cylinder discrimination at the start of the engine, in which the opening of the throttle valve 23 is held at a predetermined value suitable for the starting mode of the engine, irrespective of the accelerator opening, so that it is possible to reduce variation in the amount of intake air, which enhances the accuracy of the cylinder discrimination. Further, when the cylinder discrimination has not been successfully carried out in a particular operating condition, the throttle valve opening control shifts to a mode required after unsuccessful cylinder discrimination, in which the opening of the throttle valve 23 is held at a value suitable for successful cylinder discrimination, irrespective of the accelerator opening, so that it is possible to reduce variation in the amount of intake air, similarly to the mode required by cylinder discrimination at the start of the engine, which enhances the accuracy of the cylinder discrimination.

Figure 20:
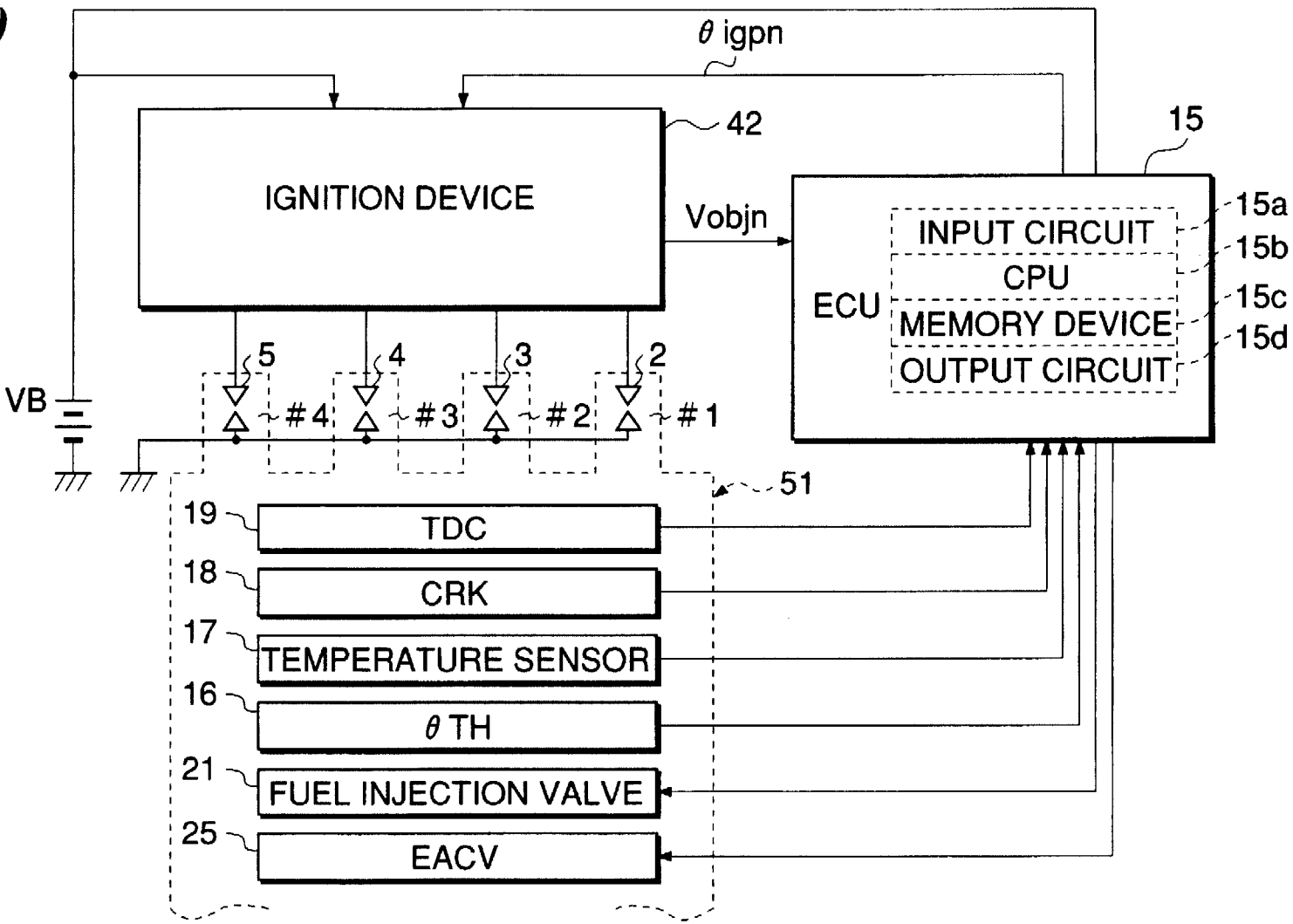
FIG. 20 is a block diagram schematically showing the whole arrangement of an internal combustion engine and a control system therefor incorporating a cylinder-discriminating device according to an eighth embodiment of the invention.

Next, an eighth embodiment of the invention will be described with reference to FIGS. 20 to 22. FIG. 20 shows the whole arrangement of an internal combustion engine, and a control system therefor including a cylinder-discriminating device according to the eighth embodiment. In the present embodiment, the cylinder-discriminating device of the invention is applied to an internal combustion engine 51 equipped with an auxiliary air control device (EACV) 25.

As shown in FIG. 20, the engine 51 includes the auxiliary air control device (EACV) 25. The EACV 25 is comprised of an auxiliary air passage, not shown, which bypasses a throttle valve arranged in an intake pipe, not shown, and an electromagnetic valve, not shown, arranged in the auxiliary air passage for controlling the amount of auxiliary air (secondary air supplied to the engine 51. The EACV 25 is electrically connected to an ECU 15. The ECU 15 carries out EACV control in which the amount of auxiliary air supplied to the engine is controlled by controlling the opening of the EACV 25 depending on operating conditions of the engine.

The remainder of the construction of the present embodiment is similar to that of one of the above embodiments, and hence description thereof is omitted. Further, in the present embodiment as well, the cylinder discrimination required by ignition timing control by the ECU 15 is carried out in a manner similar to one of those employed by the above described embodiments, and hence detailed description thereof is omitted.

Next, a manner of the EACV control required by cylinder discrimination will be described with reference to FIGS. 1 and 22. FIG. 21 shows a program for carrying out the EACV control required by cylinder discrimination at the start of the engine, while FIG. 22 shows a program for carrying out the EACV control required after unsuccessful cylinder discrimination.

Now, the EACV control required by the cylinder discrimination at the start of the engine will be described with reference to FIG. 21.

In the present embodiment, when the engine is started, the cylinder discrimination is carried out in a manner employed by one of the above described embodiments, while executing the EACV control required thereby at the same time.

Figure 21:
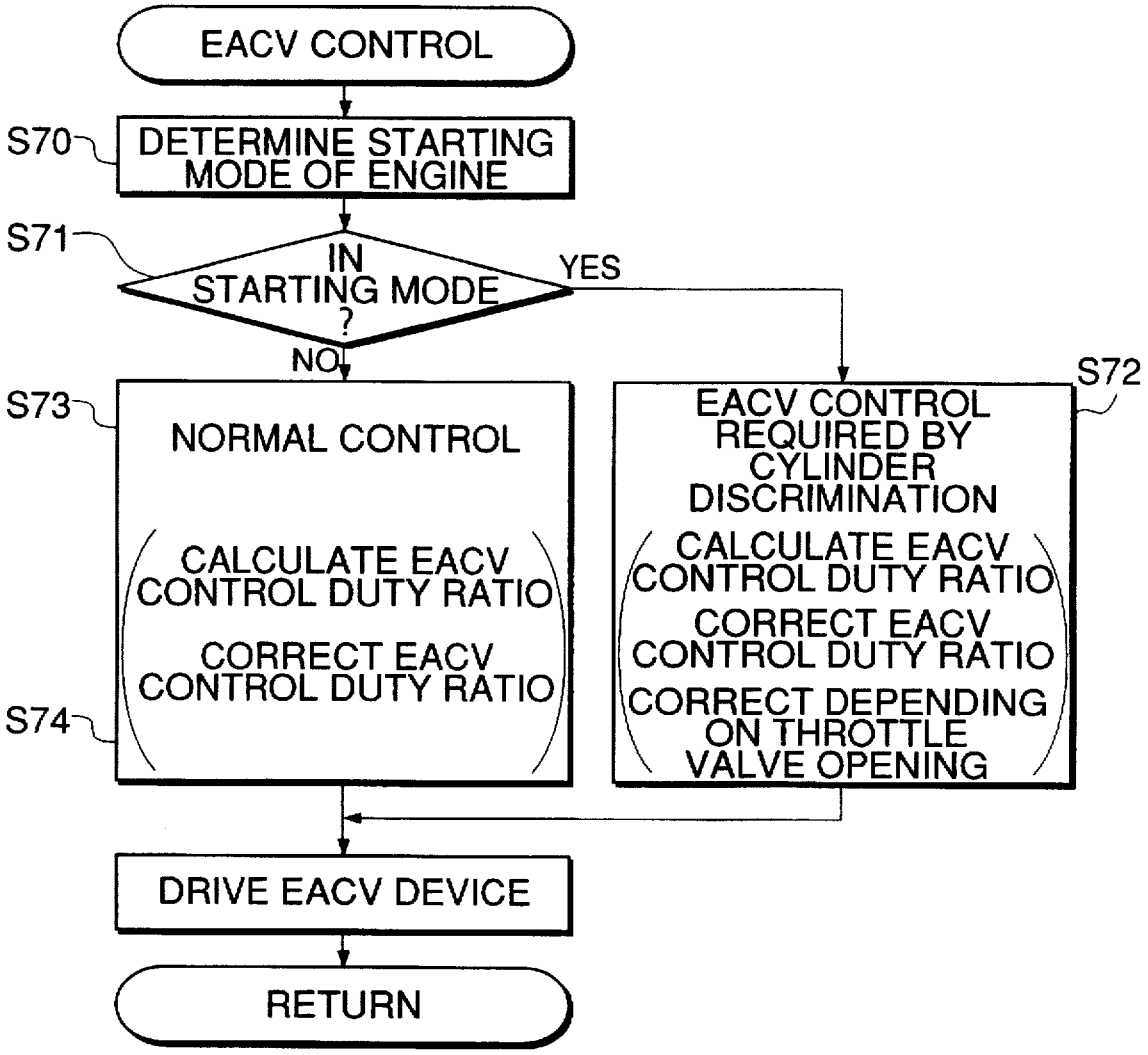
FIG. 21 is a flowchart showing a program for carrying out EACV control required by cylinder discrimination at the start of the engine.
Figure 22:
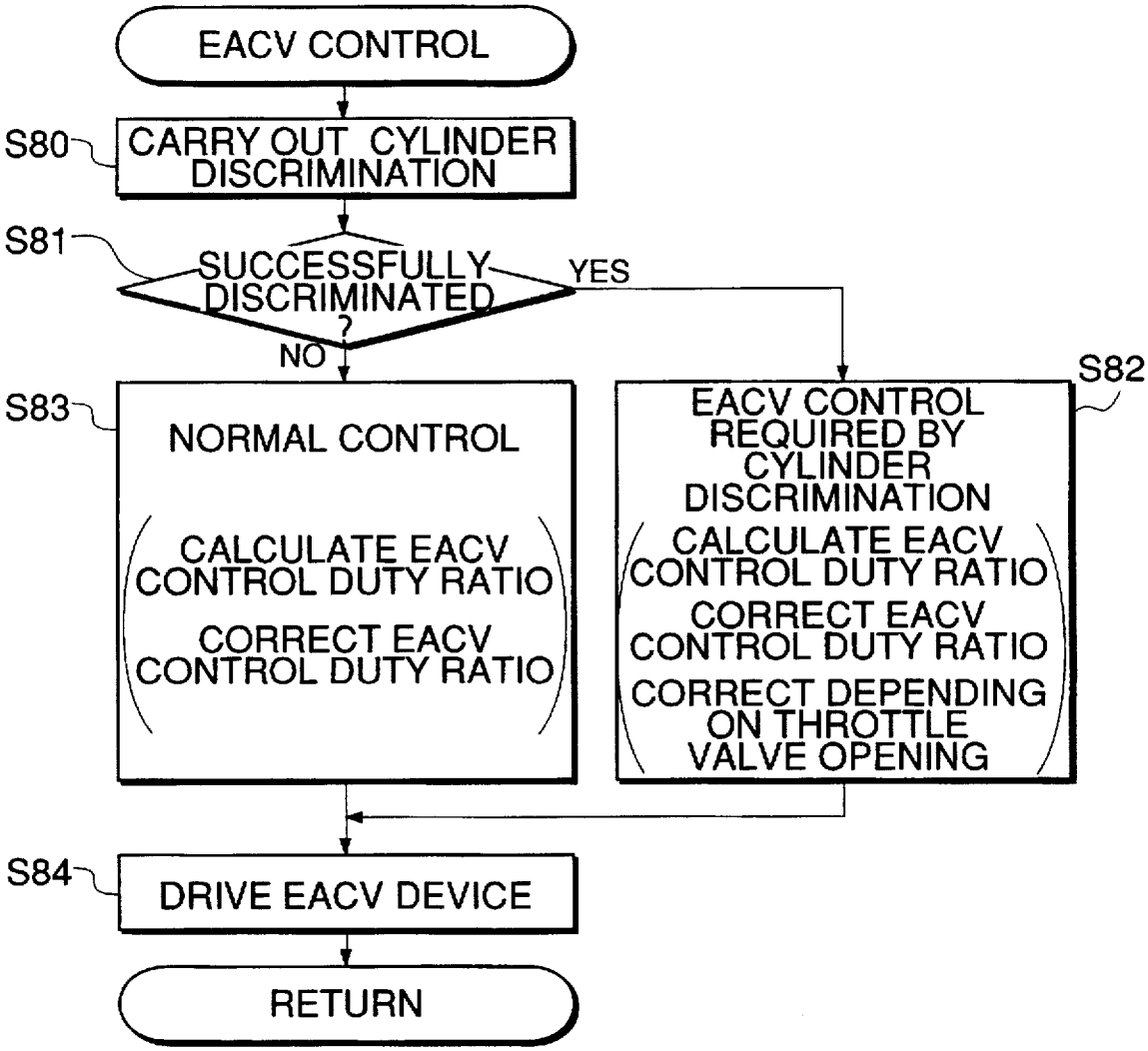
FIG. 22 is a flowchart showing a program for EACV control processing required after unsuccessful cylinder discrimination.

Referring to FIG. 21, first, at a step S70, it is determined whether or not the engine is in a starting mode, and then it is determined at a step S71 whether or not results of the determination at the step S70 show that the engine is in the starting mode.

If it is determined that the engine is in the starting mode, the program proceeds to a step S72, wherein the EACV control required by the cylinder discrimination is carried out. In this EACV control, a control duty ratio (valve opening command value) of the EACV 25 suitable for the starting mode of the engine is calculated, and the calculated duty ratio is corrected depending on the temperature of the engine. The corrected control duty ratio (valve opening command value) of the EACV 25 is further corrected according to the throttle valve opening θ TH such that the amount of intake air becomes constant.

After calculating the control duty ratio (valve opening command value) of the EACV 25, the program proceeds to a step S74, wherein the EACV 25 is driven according to the corrected control duty ratio (valve opening command value), followed by terminating the program.

On the other hand, if it is determined at the step S71 that the engine is not in the starting mode, the program proceeds to a step S73 to start normal EACV control, in which the control duty ratio (valve opening command value) of the EACV 25 is calculated based on operating conditions of the engine, and the calculated control duty ratio is corrected depending on the temperature of the engine.

After calculating the control duty ratio (valve opening command value) of the EACV 25, the program proceeds to the step S74, wherein the EACV 25 is driven according to the corrected control duty ratio (valve opening command value), followed by terminating the program.

Next, when the engine is in a particular operating condition (predetermined decelerating condition), cylinder discrimination is carried out in a manner employed by one of the above described embodiments. If the cylinder discrimination has not been successfully carried out, EACV control required after unsuccessful cylinder discrimination is executed. This EACV control is for making conditions of intake air in each cylinder suitable for successful cylinder discrimination, through adjustment of the amount of intake air drawn into the cylinder by controlling the opening of the EACV 25.

This EACV control will be described with reference to FIG. 22. First, at a step S80, the cylinder discrimination is carried out, and at the following step S81, it is determined whether the cylinder discrimination has been successfully carried out to determine the compression TDC position of a particular cylinder (or each cylinder or cylinder group).

If it is determined that the cylinder discrimination has not been successfully carried out, the program proceeds to a step S82, wherein the EACV control required after unsuccessful cylinder discrimination is carried out. In this control, a control duty ratio (valve opening command value) of the EACV 25 suitable for successful cylinder discrimination is calculated, and the calculated control duty ratio is corrected depending on the temperature of the engine. The corrected control duty ratio (valve opening command value) of the EACV 25 is further corrected according to the throttle valve opening θ TH such that the amount of intake air becomes constant.

After calculating the control duty ratio (valve opening command value) of the EACV 25, the program proceeds to a step S84, wherein the EACV 25 is driven according to the corrected control duty ratio (valve opening command value), followed by terminating the program.

On the other hand, if it is determined at the step S81 that the cylinder discrimination has been successfully carried out, the program proceeds to a step S83 to start normal EACV control, in which the control duty ratio (valve opening command value) of the EACV 25 is calculated based on operating conditions of the engine, and the calculated control duty ratio is corrected depending on the temperature of the engine.

After calculating the control duty ratio (valve opening command value) of the EACV 25, the program proceeds to the step S84, wherein the EACV 25 is driven according to the corrected control duty ratio (valve opening command value), followed by terminating the program.

Thus, according to the present embodiment, when the engine equipped with the EACV 25 is started, the EACV control shifts to a mode required by cylinder discrimination at the start of the engine, in which the amount of auxiliary air supplied to the engine in response to the accelerator opening is adjusted by the EACV 25, whereby it is possible to reduce variation in the amount of intake air, which enhances the accuracy of the cylinder discrimination. When the engine is in the particular operating condition, if cylinder discrimination has not been successfully carried out, the EACV control shifts to a mode required after unsuccessful cylinder discrimination, in which the amount of auxiliary air supplied to the engine 51 in dependence on operating conditions of the engine 51 is adjusted by the EACV 25, which, similarly to the EACV control mode at the start of the engine, reduces variation in the amount of intake air, and thereby enhances the accuracy of the cylinder discrimination.

Although in the above embodiments, the cylinder-discriminating device of the invention is applied to the ignition timing control of an internal combustion engine, this is not limitative, but it may be applied to fuel injection timing control involved in fuel supply control of an internal combustion engine, for example.

What is claimed is:

1. A cylinder-discriminating device for an internal combustion engine having a plurality of cylinders, and ignition means for effecting ignition at said plurality of cylinders, said ignition means having ignition coils provided, respectively, for said plurality of cylinders or for a plurality of cylinder groups of said plurality of cylinders, the device comprising:

reference timing signal-generating means for generating a reference timing signal whenever said engine rotates through a predetermined rotational angle, ignition timing signal-generating means for generating an ignition timing signal for causing ignition at a particular cylinder of said plurality of cylinders or a particular cylinder group of said plurality of cylinder groups in synchronism with generation of said reference timing signal;

voltage-detecting means for detecting a sparking voltage produced in said particular cylinder or said particular cylinder group when said ignition timing signal is generated; and cylinder-discriminating means for carrying out cylinder discrimination to discriminate between said plurality of cylinders or between said plurality of cylinder groups, based on said sparking voltage detected by said voltage-detecting means.

2. A cylinder-discriminating device according to claim 1, wherein said cylinder-discriminating means compares between a value of said sparking voltage detected by said voltage-detecting means and a predetermined voltage value, and carries out said cylinder discrimination, based on results of said comparison.

3. A cylinder-discriminating device according to claim 2, wherein said predetermined voltage value is set to a value close to a sparking voltage to be produced at a top dead center position of each of said plurality of cylinders at an end of a compression stroke thereof, said cylinder-discriminating means carrying out said cylinder discrimination by determining that said particular cylinder or said particular cylinder group was at said top dead center position at said end of said compression stroke when said ignition timing signal was generated, if said sparking voltage produced in said particular cylinder or said particular cylinder group, detected by said voltage-detecting means, is higher than said predetermined voltage value.

4. A cylinder-discriminating device according to claim 1, wherein said cylinder-discriminating means compares between values of said sparking voltage produced in said particular cylinder or said particular cylinder group, detected by said voltage-detecting means over one cycle of operation of said engine, and carries out said cylinder discrimination, based on results of said comparison.

5. A cylinder-discriminating device according to claim 1, wherein said cylinder-discriminating means carries out said cylinder discrimination when said engine is in a particular operating condition.

6. A cylinder-discriminating device according to claim 5, wherein said particular operating condition of said engine includes at least a starting condition of said engine.

7. A cylinder-discriminating device according to claim 6, wherein said particular operating condition of said engine includes at least a predetermined decelerating condition of said engine.

8. A cylinder-discriminating device according to claim 1, wherein said sparking voltage-detecting means detects, as said sparking voltage, a voltage on a primary side of one of said ignition coils which corresponds to said particular cylinder or said particular cylinder group.

9. A cylinder-discriminating device according to claim 1, wherein said sparking voltage-detecting means detects, as said sparking voltage, a voltage on a secondary side of one of said ignition coils which corresponds to said particular cylinder or said particular cylinder group.

10. A cylinder-discriminating device according to claim 1, wherein said engine includes intake air amount control means for controlling an amount of intake air supplied to said engine, said cylinder-discriminating device including means for causing said intake air amount control means to control said amount of intake air in a manner such that said intake air is supplied to said engine in an amount suitable for said cylinder discrimination.

11. A cylinder-discriminating device according to claim 1, wherein said engine includes auxiliary air amount control means for controlling an amount of auxiliary air supplied to said engine, said cylinder-discriminating device including means for causing said auxiliary air amount control means to control said amount of auxiliary air in a manner such that said auxiliary air is supplied to said engine in an amount suitable for said cylinder discrimination.

12. A cylinder-discriminating device according to claim 1, wherein said engine includes a crankshaft, said predetermined rotational angle corresponding to a rotational angle of said crankshaft which is smaller than 90 degrees.

13. A cylinder-discriminating device according to claim 1, wherein said predetermined rotational angle of said engine corresponds to an interval of generation of TDC signal pulses each generated when any of said plurality of cylinders is at a top dead center position.

14. A cylinder-discriminating device for an internal combustion engine having a plurality of cylinders, and ignition means for effecting ignition at said plurality of cylinders, said ignition means having ignition coils provided, respectively, for said plurality of cylinders or for a plurality of cylinder groups of said plurality of cylinders, the device comprising:

reference timing signal-generating means for generating a reference timing signal whenever said engine rotates through a predetermined rotational angle, ignition timing signal-generating means for generating ignition timing signals for causing ignition at respective ones of said plurality of cylinders or respective ones of said cylinder groups in synchronism with generation of said reference timing signal;

voltage-detecting means for detecting sparking voltages produced in said respective ones of said plurality of cylinders or said respective ones of said cylinder groups when said ignition timing signals are delivered; and cylinder-discriminating means for carrying out cylinder discrimination to discriminate between said plurality of cylinders or between said plurality of cylinder groups, based on said sparking voltages detected by said voltage-detecting means.

15. A cylinder-discriminating device according to claim 14, wherein said cylinder-discriminating means compares between values of said sparking voltages produced in said respective ones of said plurality of cylinders or said respective ones of said plurality of cylinder groups, detected by said voltage-detecting means, and carries out said cylinder discrimination, based on results of said comparison.

16. A cylinder-discriminating device according to claim 15, wherein said cylinder-discriminating means determines one of said values of said sparking voltages produced in said respective ones of said plurality of cylinders or said respective ones of said plurality of cylinder groups, detected by said voltage-detecting means, which has a largest absolute value, and determines that one of said plurality of cylinders or one of said cylinder groups corresponding to said one of said values of said sparking voltages, which has the largest absolute value, was at a top dead center position of said one of said plurality of cylinders or said one of said cylinder groups at an end of a compression stroke thereof when a corresponding one of said ignition timing signals was generated.

17. A cylinder-discriminating device according to claim 14, wherein said cylinder-discriminating means compares between values of said sparking voltage produced in said respective ones of said plurality of cylinders or said respective ones of said cylinder groups with a predetermined voltage value, and carries out said cylinder discrimination, based on results of said comparison.

18. A cylinder-discriminating device according to claim 14, wherein said cylinder-discriminating means carries out said cylinder discrimination when said engine is in a particular operating condition.

19. A cylinder-discriminating device according to claim 18, wherein said particular operating condition of said engine includes at least a starting condition of said engine.

20. A cylinder-discriminating device according to claim 19, wherein said particular operating condition of said engine includes at least a predetermined decelerating condition of said engine.

21. A cylinder-discriminating device according to claim 14, wherein said sparking voltage-detecting means detects, as said sparking voltages, voltages on primary sides of said ignition coils.

22. A cylinder-discriminating device according to claim 14, wherein said sparking voltage-detecting means detects, as said sparking voltages, voltages on secondary sides of said ignition coils.

23. A cylinder-discriminating device according to claim 14, wherein said engine includes intake air amount control means for controlling an amount of intake air supplied to said engine, said cylinder-discriminating device includes means for causing said intake air amount control means to control said amount of intake air in a manner such that said intake air is supplied to said engine in an amount suitable for said cylinder discrimination.

24. A cylinder-discriminating device according to claim 14, wherein said engine includes auxiliary air amount control means for controlling an amount of auxiliary air supplied to said engine, said cylinder-discriminating device includes means for causing said auxiliary air amount control means to control said amount of auxiliary air in a manner such that said auxiliary air is supplied to said engine in an amount suitable for said cylinder discrimination.

* * * * *